US011220312B2

(12) United States Patent
Jesewitz et al.

(10) Patent No.: US 11,220,312 B2
(45) Date of Patent: Jan. 11, 2022

(54) COLLAPSIBLE FIN SHADE APPARATUS FOR BOATS

(71) Applicants: Raymond Jesewitz, Apopka, FL (US); Alan Taylor, Myakka City, FL (US)

(72) Inventors: Raymond Jesewitz, Apopka, FL (US); Alan Taylor, Myakka City, FL (US)

( * ) Notice: Subject to any disclaimer, the term of this patent is extended or adjusted under 35 U.S.C. 154(b) by 0 days.

(21) Appl. No.: 16/796,917

(22) Filed: Feb. 20, 2020

(65) Prior Publication Data

US 2021/0039751 A1 Feb. 11, 2021

Related U.S. Application Data

(63) Continuation-in-part of application No. 15/730,727, filed on Oct. 11, 2017, now Pat. No. 10,604,214.

(60) Provisional application No. 62/966,022, filed on Jan. 26, 2020.

(51) Int. Cl.
*B63B 17/02* (2006.01)

(52) U.S. Cl.
CPC ..... *B63B 17/02* (2013.01); *B63B 2017/026* (2013.01); *B63B 2221/24* (2013.01)

(58) Field of Classification Search
CPC ..... B63B 17/02; B63B 2017/026; B63B 2221/24
See application file for complete search history.

(56) References Cited

U.S. PATENT DOCUMENTS

| | | | | |
|---|---|---|---|---|
| 7,159,634 | B1 * | 1/2007 | Judkins | B26D 1/09 156/197 |
| 8,757,185 | B1 * | 6/2014 | Muzzio | B63B 17/02 135/88.01 |
| 9,194,152 | B1 * | 11/2015 | Plasencia | E04H 15/48 |
| 10,604,214 | B2 * | 3/2020 | Jesewitz | B63B 17/02 |
| 2014/0026803 | A1 * | 1/2014 | Musacchio | B63B 17/02 114/361 |
| 2014/0211489 | A1 * | 7/2014 | Braaten-Boyd | B63B 17/02 362/477 |
| 2015/0122169 | A1 * | 5/2015 | Russikoff | B63B 17/02 114/361 |
| 2021/0039751 | A1 * | 2/2021 | Jesewitz | B63B 17/02 |

* cited by examiner

*Primary Examiner* — S. Joseph Morano
*Assistant Examiner* — Jovon E Hayes
(74) *Attorney, Agent, or Firm* — The Patent Guild; Paul Royal

(57) ABSTRACT

A collapsible fin shade apparatus for a boat.

8 Claims, 27 Drawing Sheets

COLLAPSIBLE FIN SHADE APPARATUS FOR BOATS

CROSS-REFERENCE TO RELATED APPLICATIONS

This application is a Continuation-In-Part of patent application Ser. No. 15/730,727, filed Oct. 11, 2017 and this application claims the benefit of U.S. Provisional Application No. 62/966,022, filed Jan. 26, 2020.

BACKGROUND OF THE INVENTION

Field of the Invention

The invention relates to the field collapsible boat shade systems. Boaters want as much shade as they can get so that they can stay out of the harmful rays of the sun and remain cool on a hot summer day. Many types of boats currently do not have adequate shade due to the limitations of the shade devices offered on the market.

Some shade devices are too small in size to provide proper shade, such as a T-Top on a sport fishing boat. Generally, the T-top does not provide sun protection in the front or the rear section of the boat. Certain add-on shade devices for T-tops require vertical poles and fabric to create shade. The vertical poles from these devices restrict boating activities, such as fishing.

Bimini style shade devices that are attached to the gunwale of a boat are cumbersome to fold and unfold and also restrict movement of the boater, especially when boarding, disembarking, and engaging in watersports activities.

BRIEF SUMMARY OF THE INVENTION

It is therefore an object of the invention to provide a collapsible fin shade apparatus for a boat. The instant invention provides a boat top mounted shade device that is extendable/retractable to provide adjustable overhead coverage from the sun. The unique shade device attaches to a boat top without any vertical supports to restrict any boating activities. The fabric on the shade device stretches out to provide ample coverage from the sun in the front and/or the rear of the boat and collapses easily to a stored position when not in use. The collapsible fin shade apparatus is also easily removable from the boat. By altering the position of components of the instant invention a variety of shaded areas can be provided in conjunction with selected canvas 900 shapes.

Other novel features which are characteristic of the apparatus, as to organization and method of operation, together with further objects and advantages thereof will be better understood from the following description considered in connection with the accompanying figures, in which preferred embodiments of the apparatus are illustrated by way of example. It is to be expressly understood, however, that the figures are for illustration and description only and is not intended as a definition of the limits of the apparatus. The various features of novelty which characterize the apparatus are pointed out with particularity in the claims annexed to and forming part of this disclosure. The apparatus resides not in any one of these features taken alone, but rather in the particular combination of all of its structures for the functions specified.

BRIEF DESCRIPTION OF THE SEVERAL VIEWS OF THE DRAWINGS

The apparatus will be better understood and objects other than those set forth above will become apparent when consideration is given to the following detailed description thereof. Such description refers to the annexed drawings, wherein.

DETAILED DESCRIPTION OF THE INVENTION

Referring now to FIGS. 1-23 in an exemplary embodiment presented is a collapsible fin shade apparatus for boats.

Figure 1:
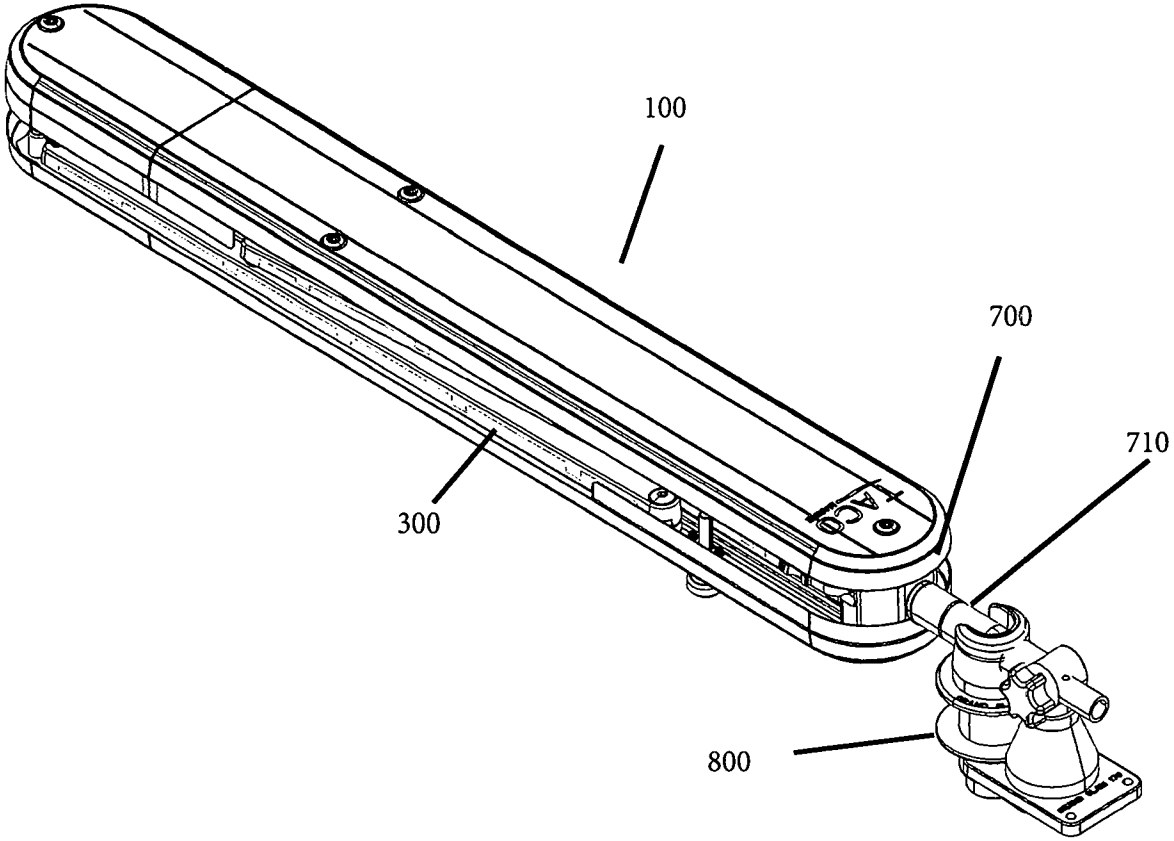
FIG. 1 presents a view of the preferred embodiment of the collapsible fin shade apparatus.
Figure 1A:
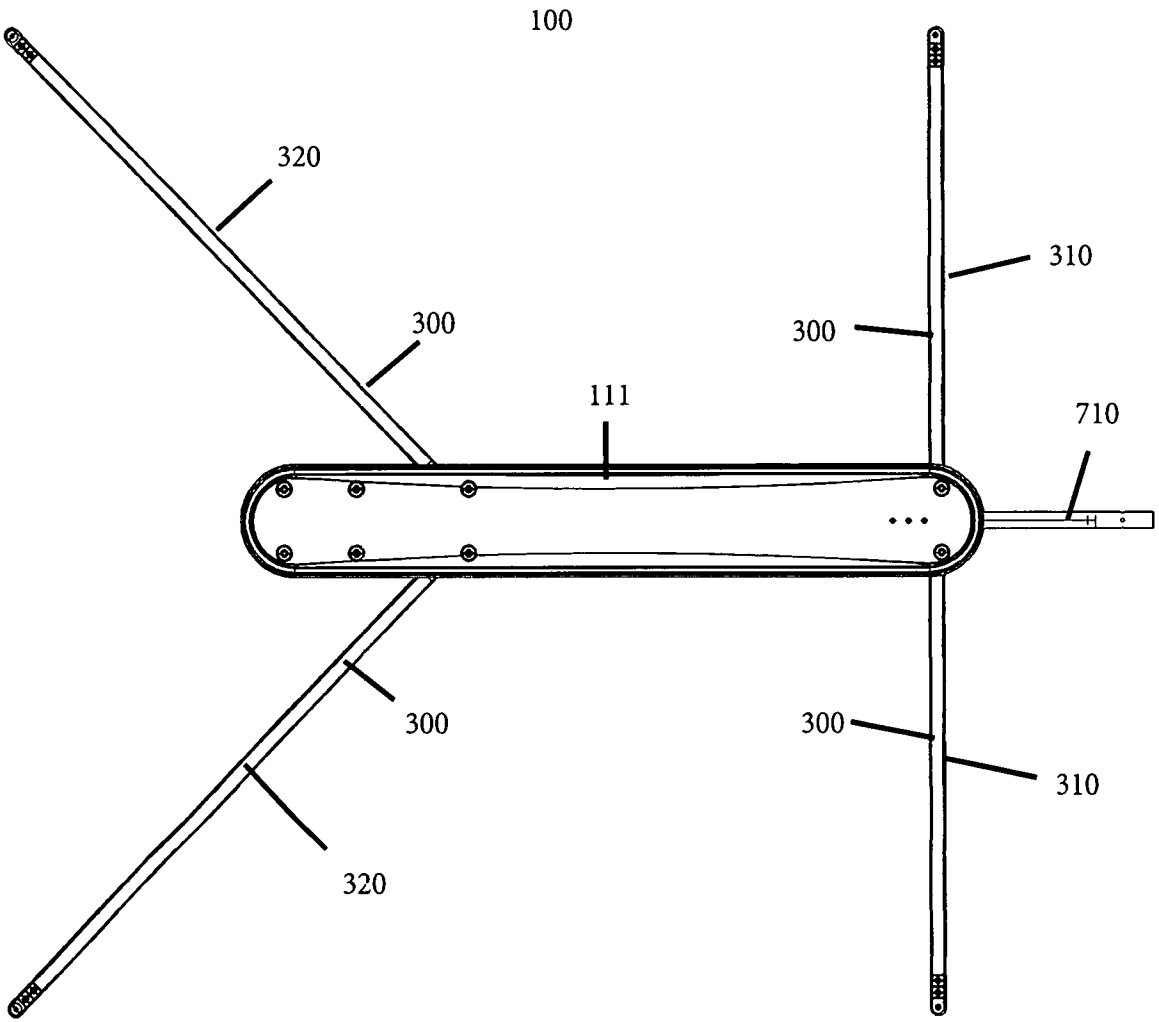
FIG. 1A presents a view of the preferred embodiment of the collapsible fin shade apparatus.
Figure 1B:
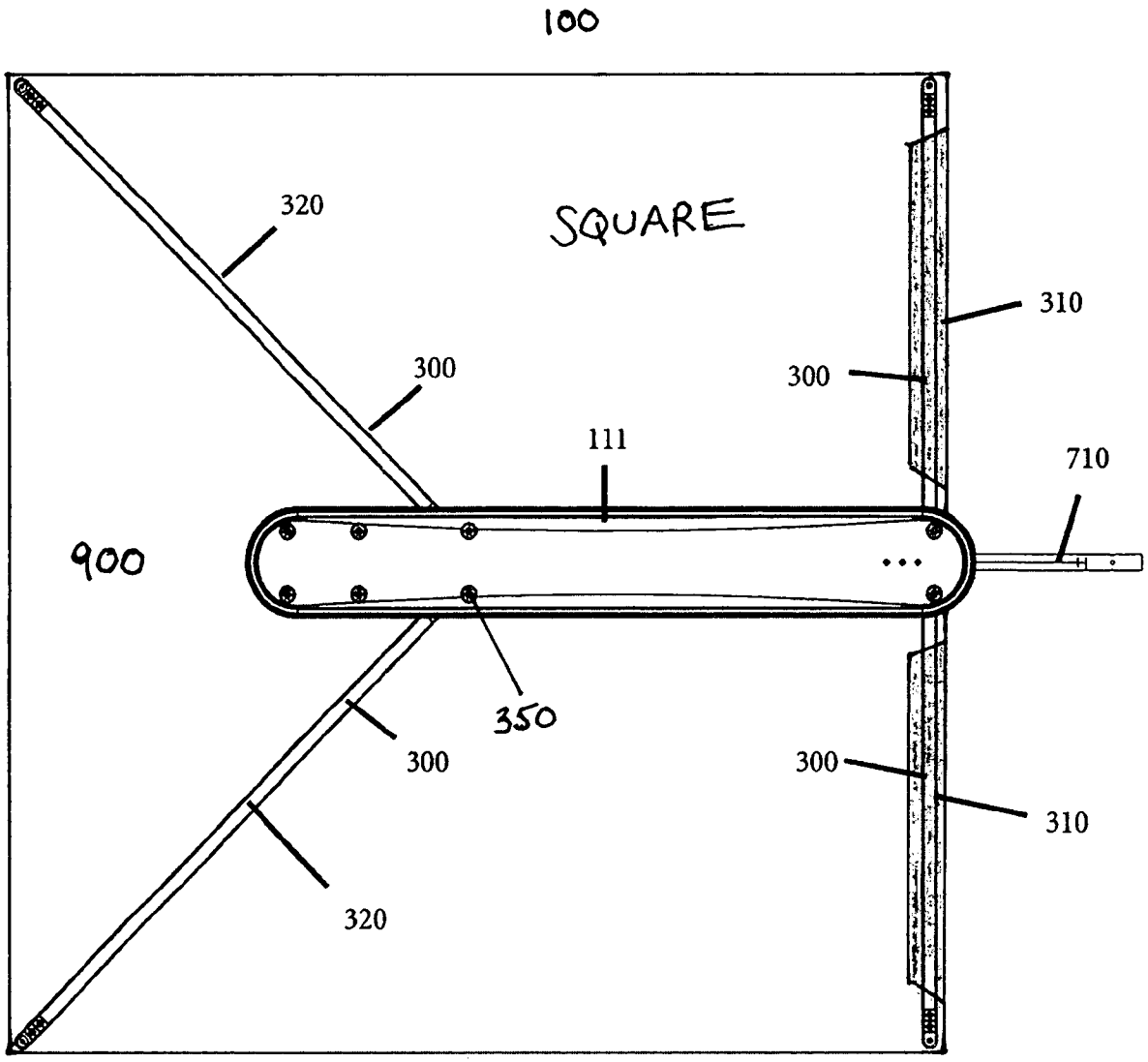
FIG. 1B presents a square shape canvas of the collapsible fin shade apparatus.
Figure 2:
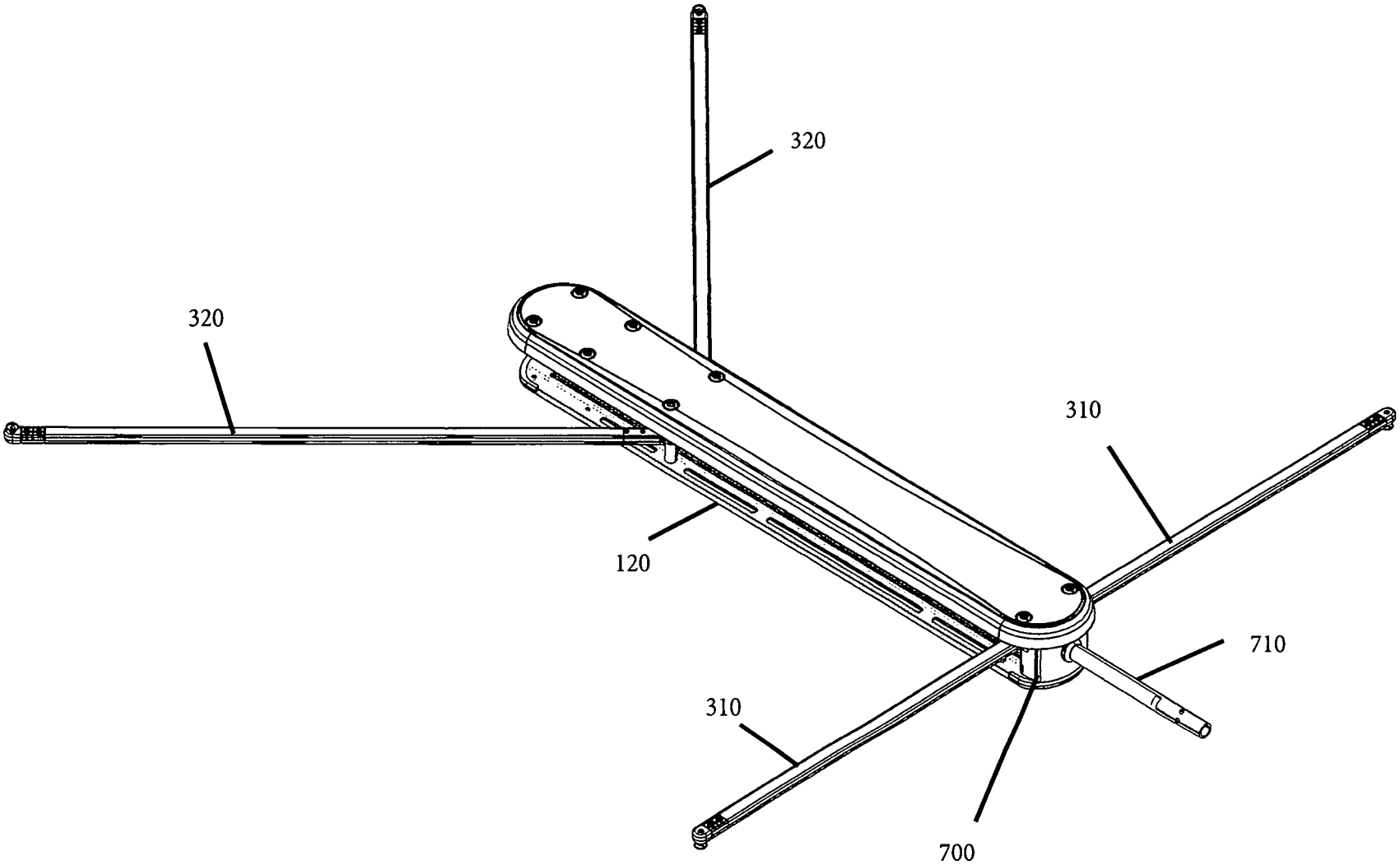
FIG. 2 presents a view of the preferred embodiment of the collapsible fin shade apparatus.
Figure 3:
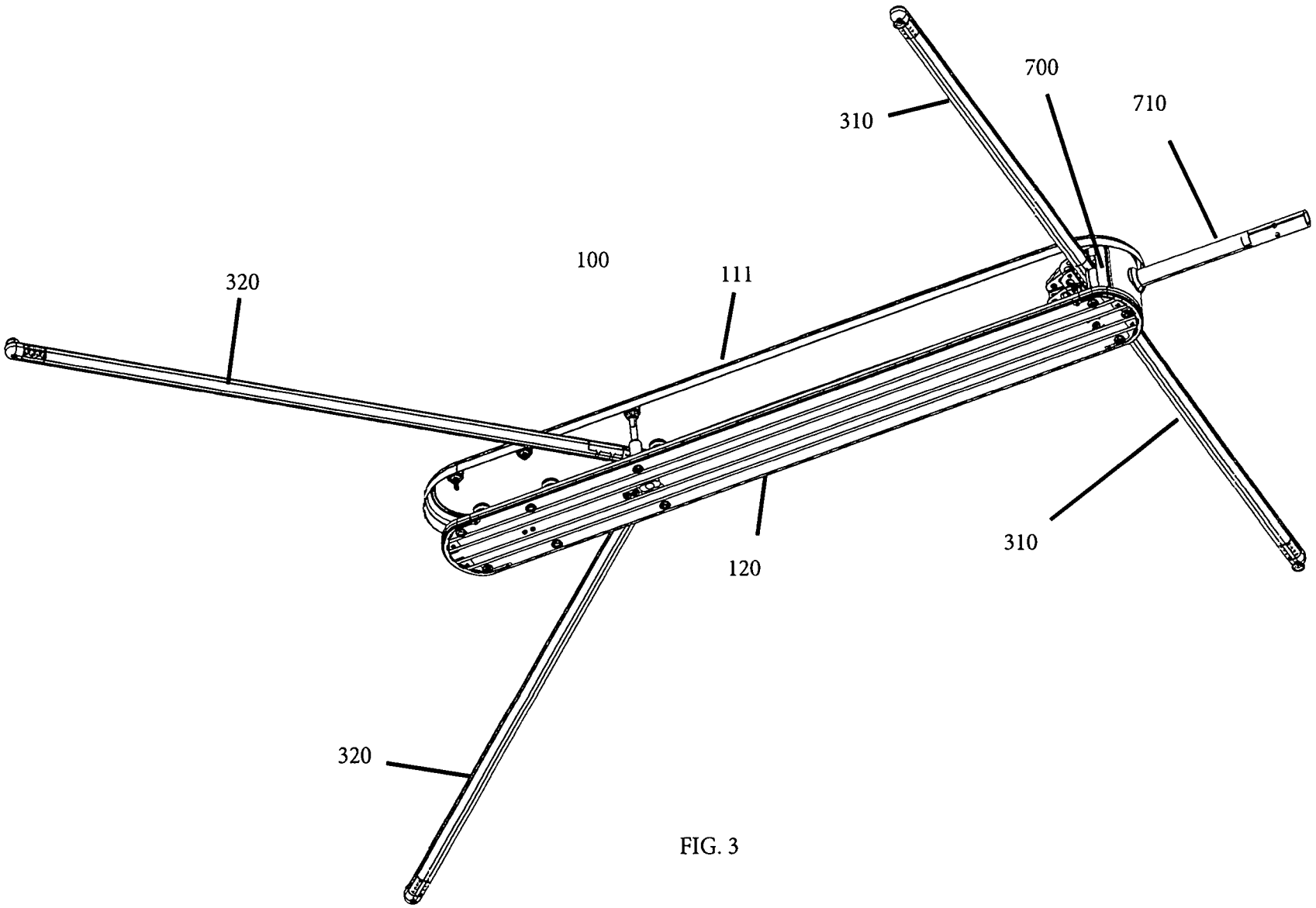
FIG. 3 presents a view of the preferred embodiment of the collapsible fin shade apparatus.
Figure 4:
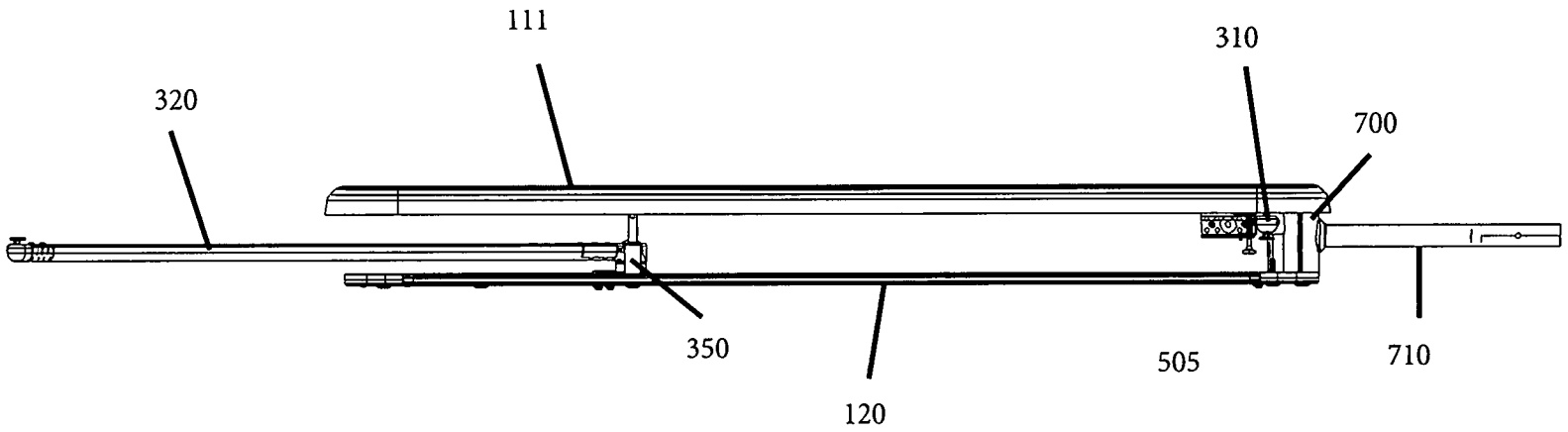
FIG. 4 presents a view of the preferred embodiment of the collapsible fin shade apparatus.
Figure 5:
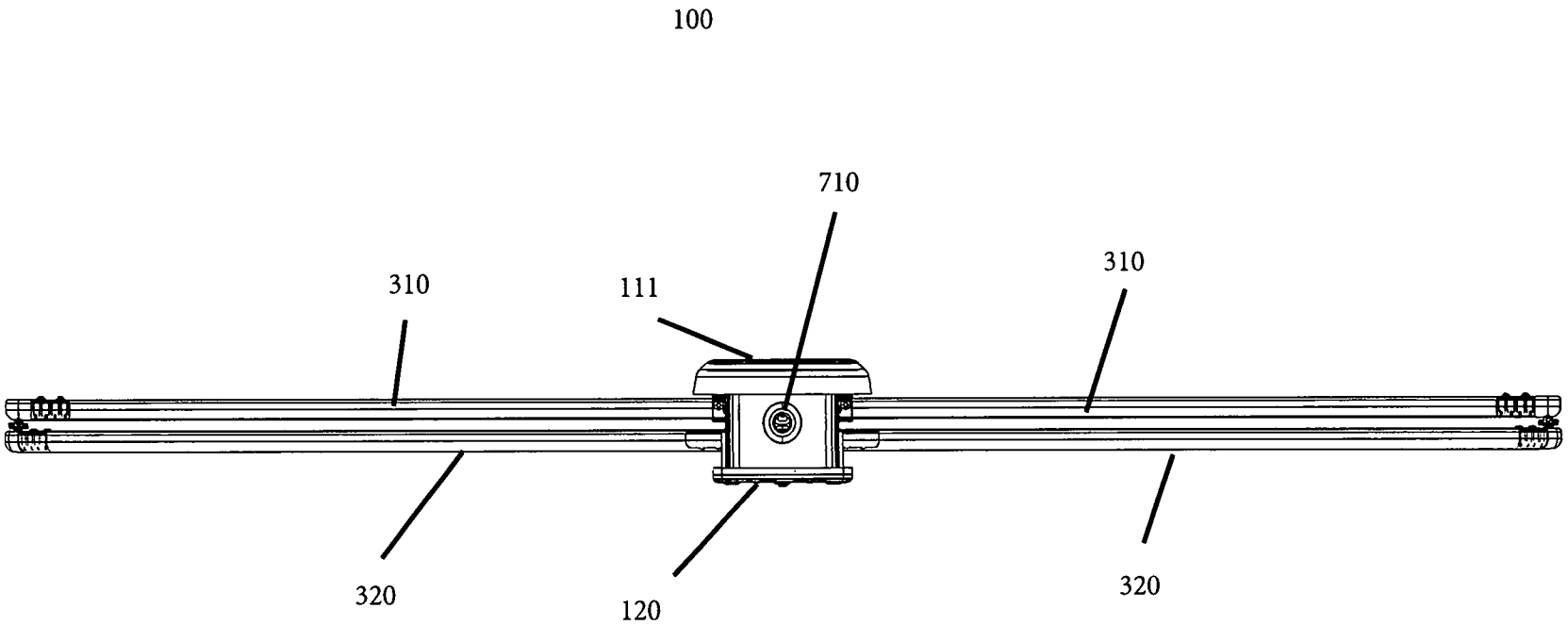
FIG. 5 presents a view of the preferred embodiment of the collapsible fin shade apparatus.
Figure 6:
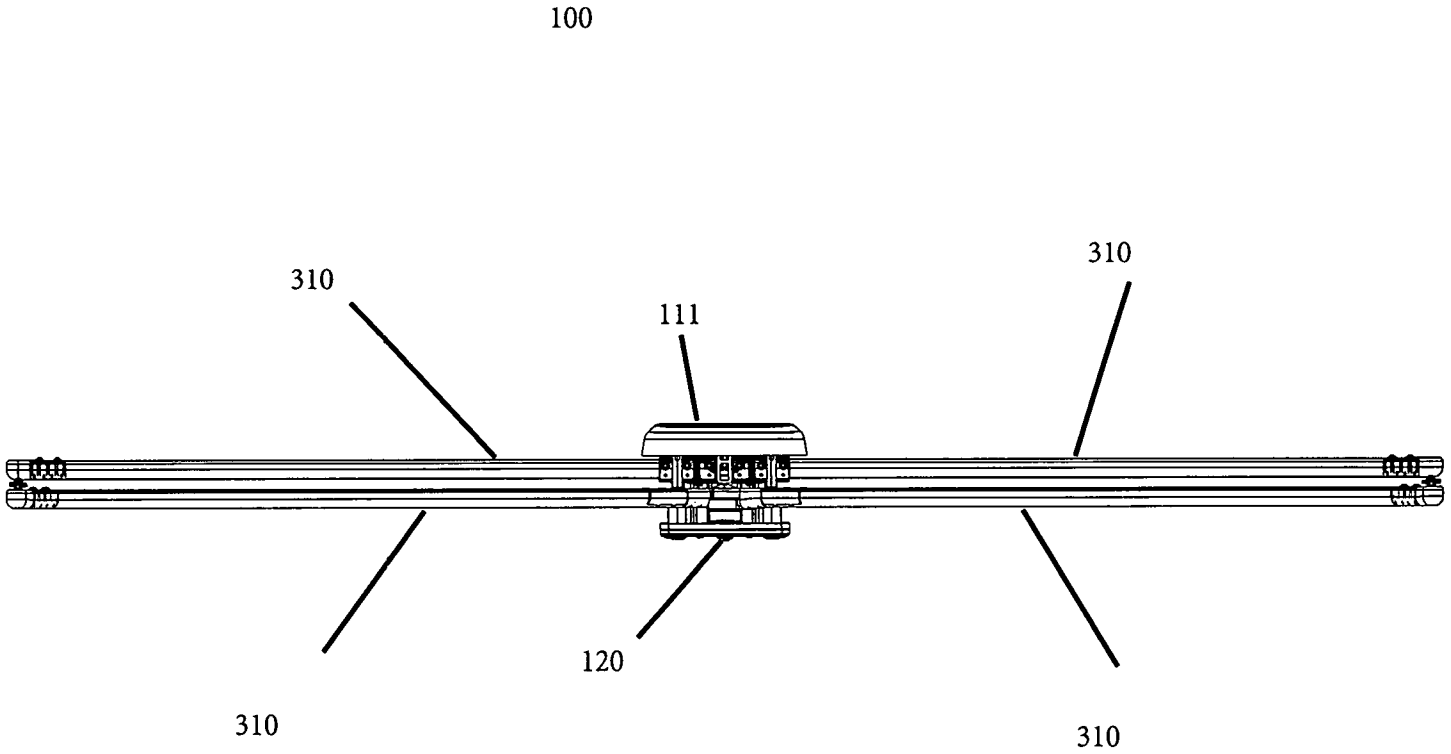
FIG. 6 presents a view of the preferred embodiment of the collapsible fin shade apparatus.

Generally, the collapsible fin shade apparatus 100 is stored and transported in a closed/collapsed position (as shown in FIG. 1) and used in an open/extended position (see at least FIGS. 1A-3, 7-8, 10-11, and 13-14). The collapsible fin shade includes a canvas 900 attached to and considered part of the collapsible fin shade apparatus 100. In the closed/collapsed position the canvas 900 is fully contained within the collapsible fin shade apparatus 100, as shown in FIG. 1 and in an open/extended position the canvas 900 is deployed in an outstretched position to provide shade.

The collapsible fin shade apparatus 100 is inserted into a support 800 for attaching the apparatus to a variety of compatible support equipment, particularly equipment on or part of a boat.

The collapsible fin shade apparatus 100 includes at least a top assembly cover 111, a bottom assembly/mount support base 120, and a plurality of arms (spines) 300. In the closed/collapsed position the arms 300 are fully contained within the apparatus 100. In the open/extended position the arms extend outwardly away from the top assembly cover 111 and the bottom assembly 120. The canvas 900 extends along the length of each arm 300 to create a shaded area beneath the canvas 900.

The length and shape of each arm 300 and as well as the shape of the canvas 900 are selected to provide a desired shaded area beneath the canvas 900.

The support 800 allows for repositioning of the overall collapsible fin shade apparatus 100 to position the shaded area beneath the canvas 900 so that it covers selected areas.

In the preferred embodiment as shown in FIGS. 1A-9, the collapsible fin shade apparatus 100 at least includes (in addition to canvas 900):

a top assembly cover 111;

a first arm apparatus/assembly 310;

a third arm apparatus/assembly 320;

arm pivot assemblies (spine support base/pivot mechanism) 310A associated with each arm apparatus;

a bottom assembly 120 (mount support base);

a folding bracket 700; and at least one latch knob 505.

The collapsible fin shade apparatus 100 is secured in the closed/collapsed position within the top assembly cover 111 and bottom assembly 120 by at least one latch knob 505. The collapsible fin shade apparatus 100 is secured in the open/extended by the same at least one latch knob 505. Each of the embodiments of the instant invention are secured in the selected position using the same features.

Use Operation—Deployment from Closed to Open

In the preferred embodiment and subsequent embodiments, the canvas 900 applies tension force to the applicable first arm apparatus 310, and third arm apparatus 320 as described below.

Figure 21:
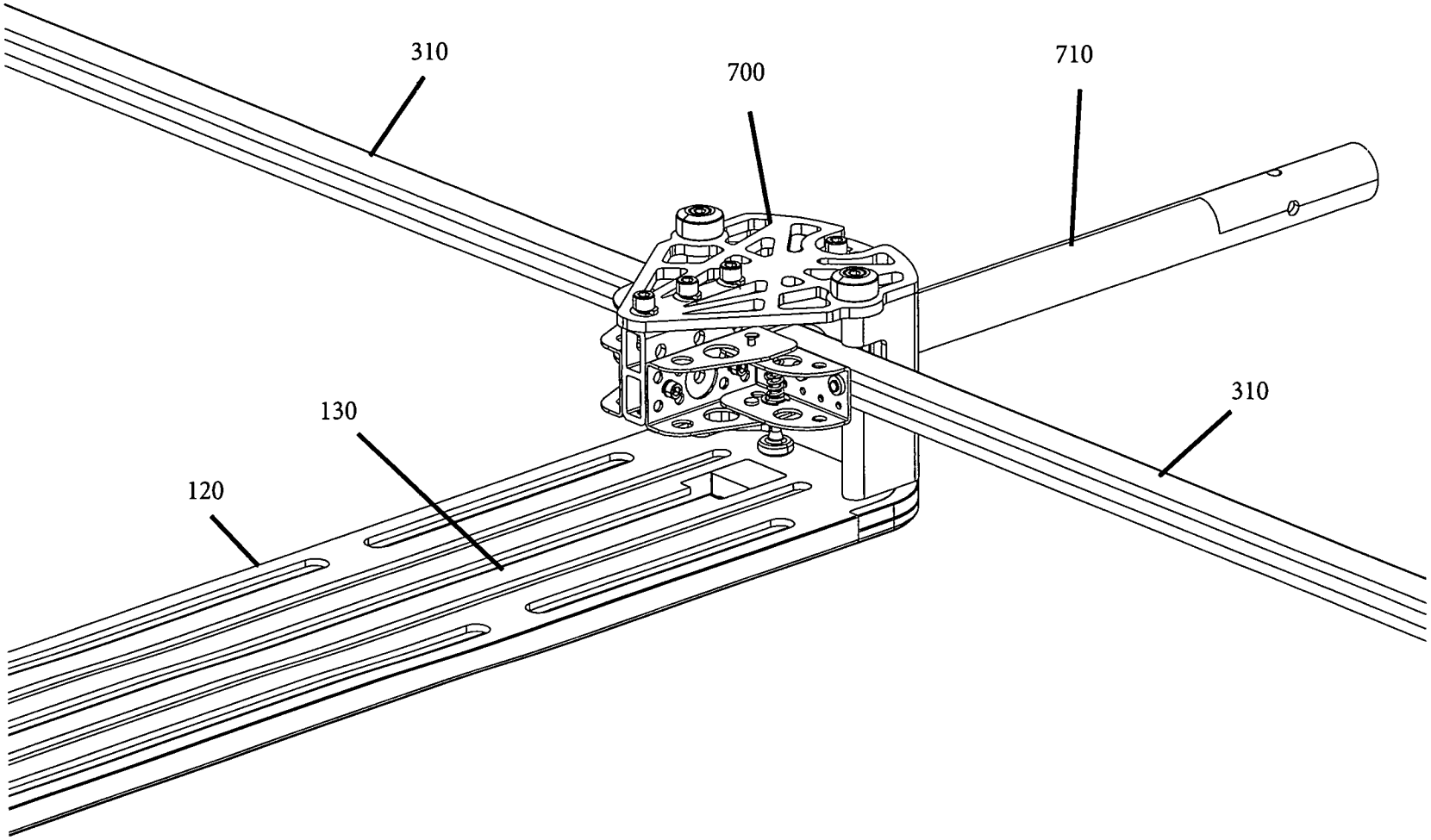
FIG. 21 presents components of the collapsible fin shade apparatus.
Figure 22:
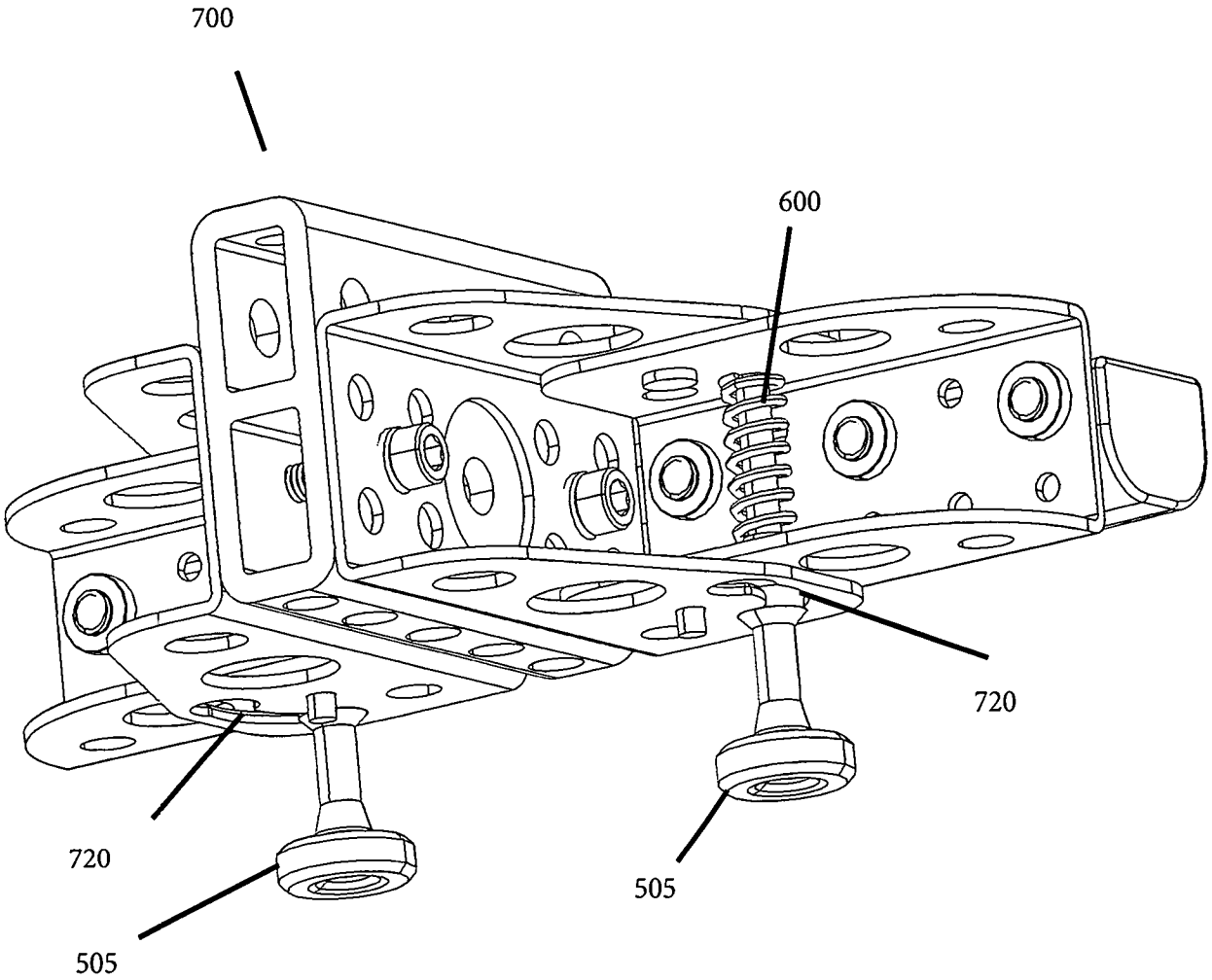
FIG. 22 presents components of the collapsible fin shade apparatus.
Figure 23:
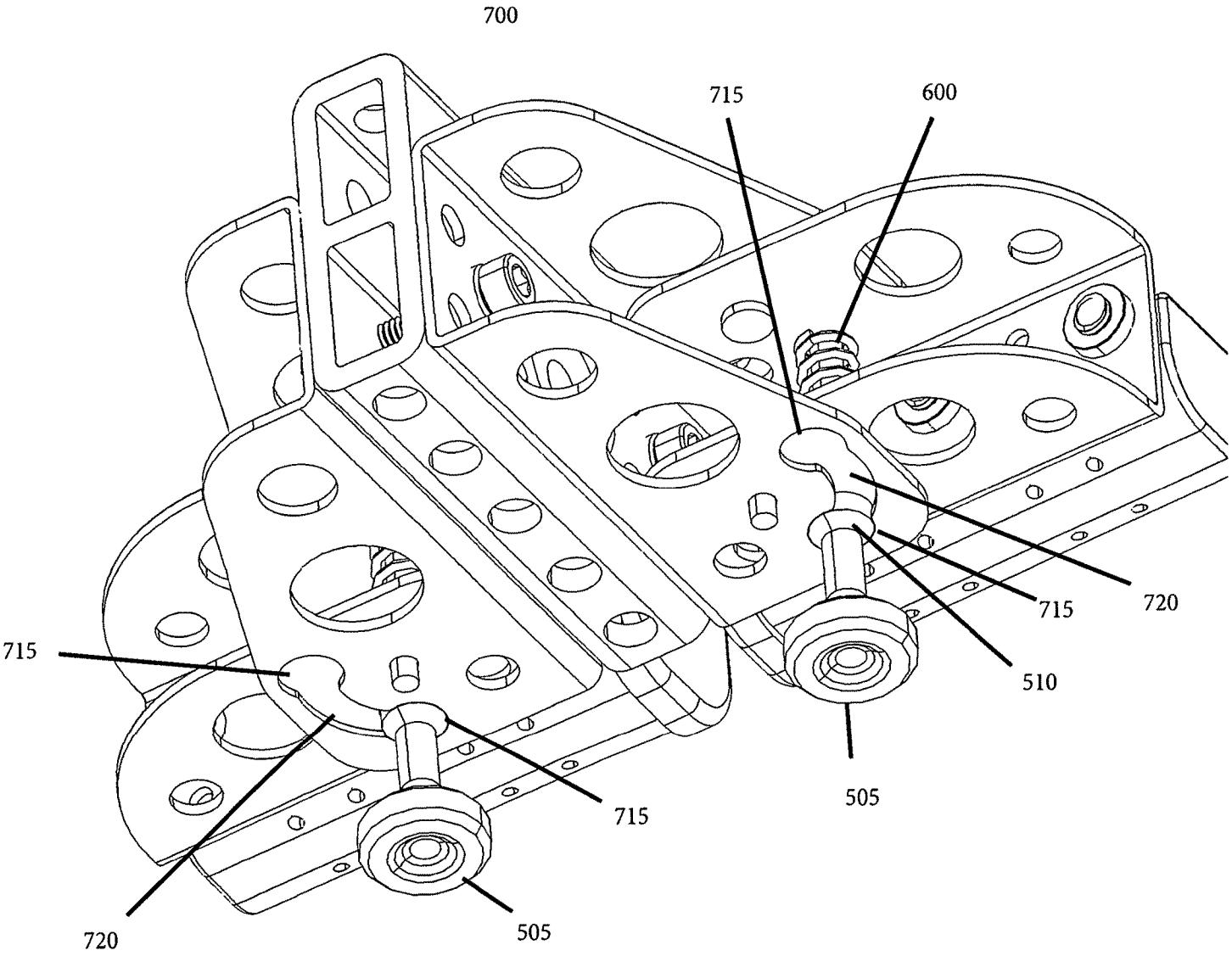
FIG. 23 presents components of the collapsible fin shade apparatus.

As shown in FIGS. 21-23, to open/extend or close/collapse the collapsible fin shade apparatus 100 users push on knob 505 which will unseat a knob shaft camphor 510 from the knob channel 720 of the folding bracket 700 thereby allowing each arm of the first arm apparatus 310 to swing outward away from or toward the top assembly cover 111. The movement of the first arm apparatus 310 may be aided by assistive devices (such as a gas spring, pretensioned spring, or similar devices). Alternate latch assembly configurations may include manual or electronically controlled components for locking or unlocking the first arm apparatus 310.

Within the folding bracket 700 a knob channel 720 guides the path of the knob shaft camphor 510. The knob channel 720 includes knob channels stops 715 positioned at opposite end of the knob channel 720. Once the knob shaft camphor 510 seats within a knob channels stop 715, spring 600 applies a force which holds the knob shaft camphor 510 within the knob channel stop 715 and secures the first arm apparatus/assembly 310 in the open or closed position.

To allow rotation of the first arm apparatus/assembly 310 users push on knob 505 which will unseat a knob shaft camphor 510.

As users transition the first arm apparatus/assembly 310 from the closed/collapsed position to the open/extended position the tension of the canvas 900 is imparted to the third arm apparatus/assembly 320 which is also attached to the canvas 900 at selected locations. This tension pulls/pushes the arm pivot assembly 310A away from the folding bracket 700 and center track 130 of the bottom assembly 120 securely guides the translation of the arm pivot assembly 310A away from the folding bracket 700.

During assembly of the collapsible fin shade apparatus 100 users insert the lock posts 350 in desired location the bottom assembly 120 which determines the stopping positions which halt the translation of the arm pivot assembly 310A in preselected locations. These locations represent positions which align the shape of the canvas 900 into forms such as a square, rectangle, trapezoid etc.

The canvas 900 is partially secured to the top of each lock post 350.

In the alternate embodiments of the instant invention, the position of the lock posts 350, in conjunction with the shape of the canvas 900 forms the selected pattern of the open/extended collapsible fin shade apparatus 100.

Figure 7:
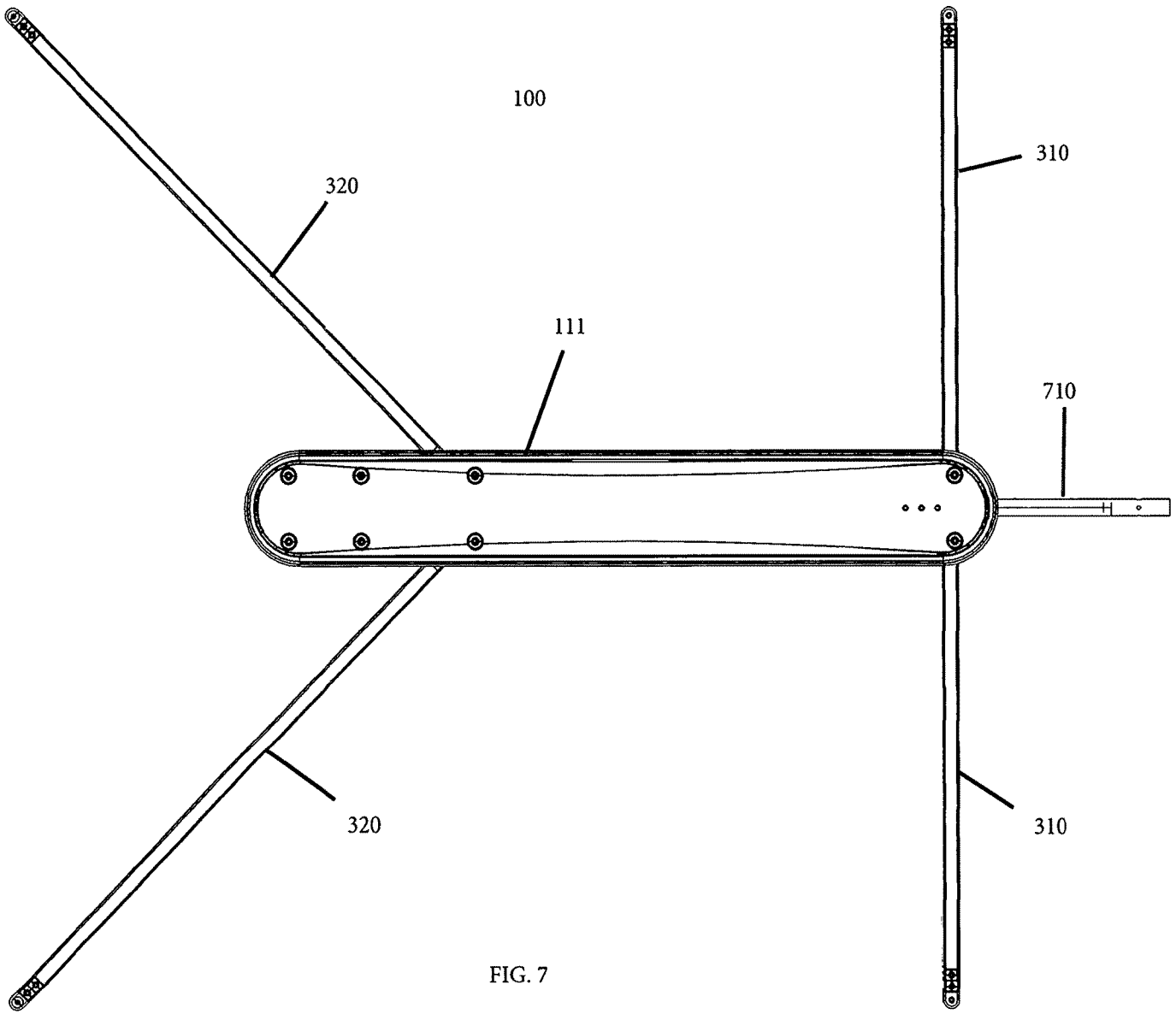
FIG. 7 presents a view of the preferred embodiment of the collapsible fin shade apparatus.
Figure 8:
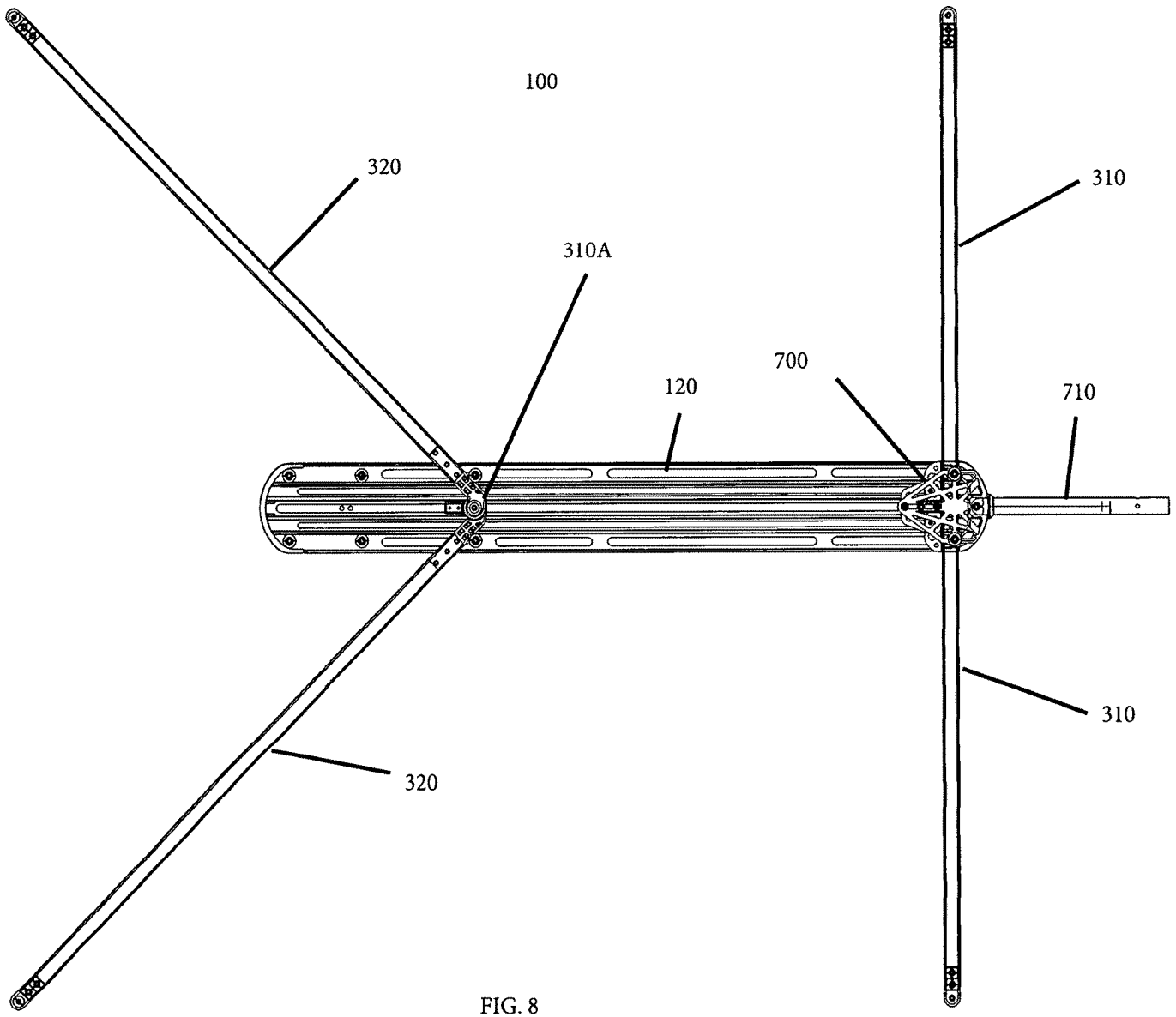
FIG. 8 presents a view of the preferred embodiment of the collapsible fin shade apparatus.
Figure 9:
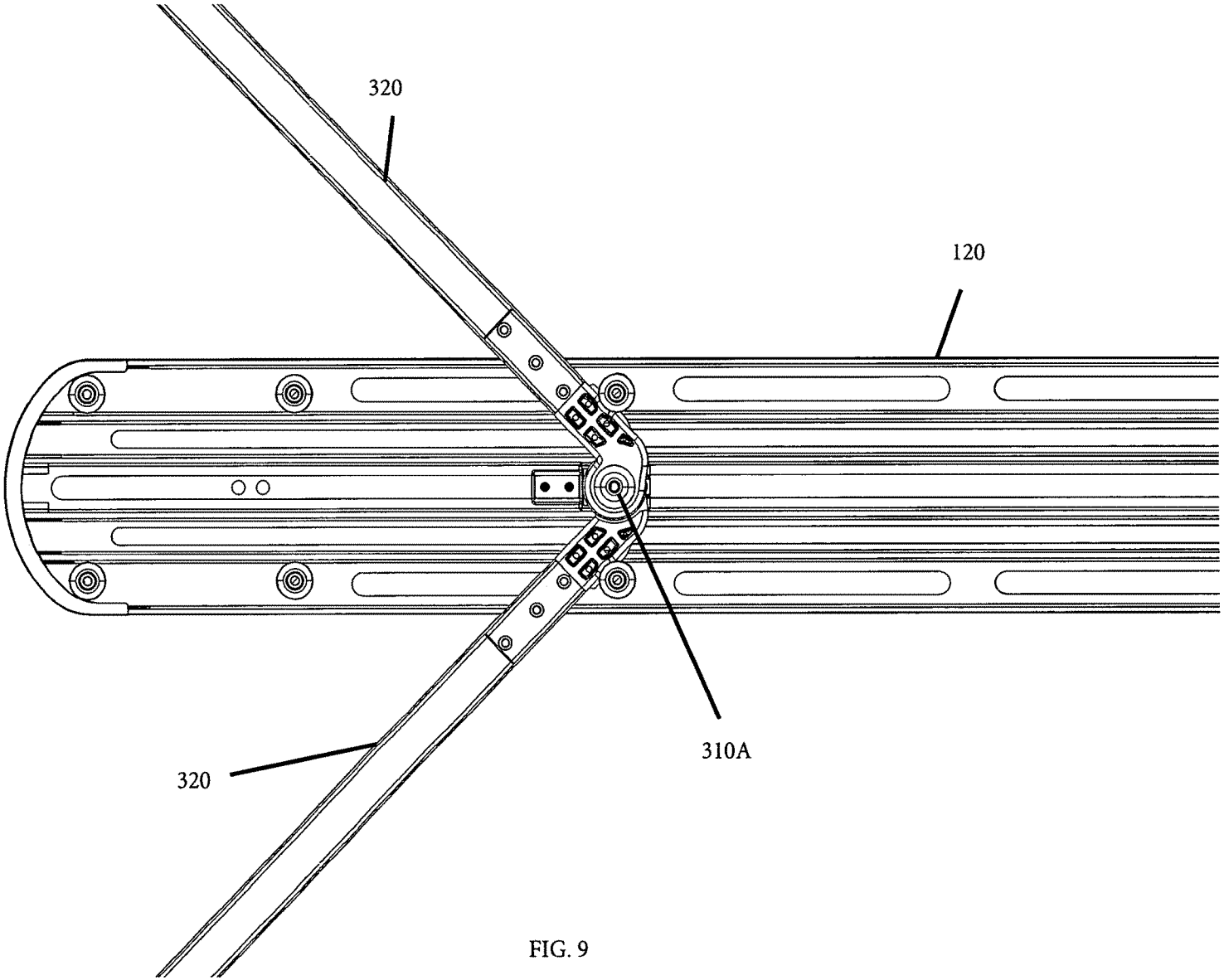
FIG. 9 presents a view of the preferred embodiment of the collapsible fin shade apparatus.

As shown in FIGS. 7-9 of the preferred embodiments the locations of lock posts 350 stop the translation of the arm pivot assembly 310A as it moves away from the folding bracket 700.

Pivotally extending from the arm pivot assembly 310A is first pivot link 310B and second pivot link 310C. Each pivot link includes a locking detent 340 shaped as an indentation in the respective pivot link. Note the locking detent 340 may also be formed by a protrusion from the pivot link.

The first pivot link 310B and second pivot link 310C are substantially similar and crafted to complimentarily work together.

The translation of the arm pivot assembly 310A along the center track 130 of the bottom assembly 120 stops when the locking detent 340 of the respective pivot link abuts respective lock post 350.

The tension applied by the canvas 900 to the arm pivot assembly 310A is selected to urge the arm pivot assembly 310A along the center track 130 of the bottom assembly 120 towards the lock post 350 but not overcome the holding force provided when the respective pivot link abuts respective lock post 350.

It is envisioned the collapsible fin shade apparatus 100 may include multiple arm pivot assemblies each having a first pivot link, and a second pivot link.

After full extension/opening of the collapsible fin shade apparatus 100, users should check that the canvas 900 is fully spread out and users should close or seal (such as via zipper or other fastener) any portions of the canvas 900 which require closing or sealing.

With the collapsible fin shade apparatus 100 securely open/extended users can reposition shaded area beneath the canvas 900 by pivoting or rotating the apparatus about a mount (800).

Use Operation—Deployment from Open to Close

To close the collapsible fin shade apparatus 100, users push up on knob 505 which will unseat a knob shaft camphor 510 from the knob channel 720 of the folding bracket 700 thereby allowing each arm of the first arm apparatus 310 to swing inward toward the top assembly cover 111 due to the tension of the canvas 900. Users can manually assist the closing of the collapsible fin shade apparatus 100 by guiding the first pivot link 310B and second pivot link 310C of the third arm apparatus/assembly 320. During closing the third arm apparatus/assembly 320 is translated along center track 130 towards folding bracket 700.

Alternate embodiments form preselected canvas 900 shapes by the user inserting the respective lock post 350 in selected sections of the bottom assembly 120.

Figure 10:
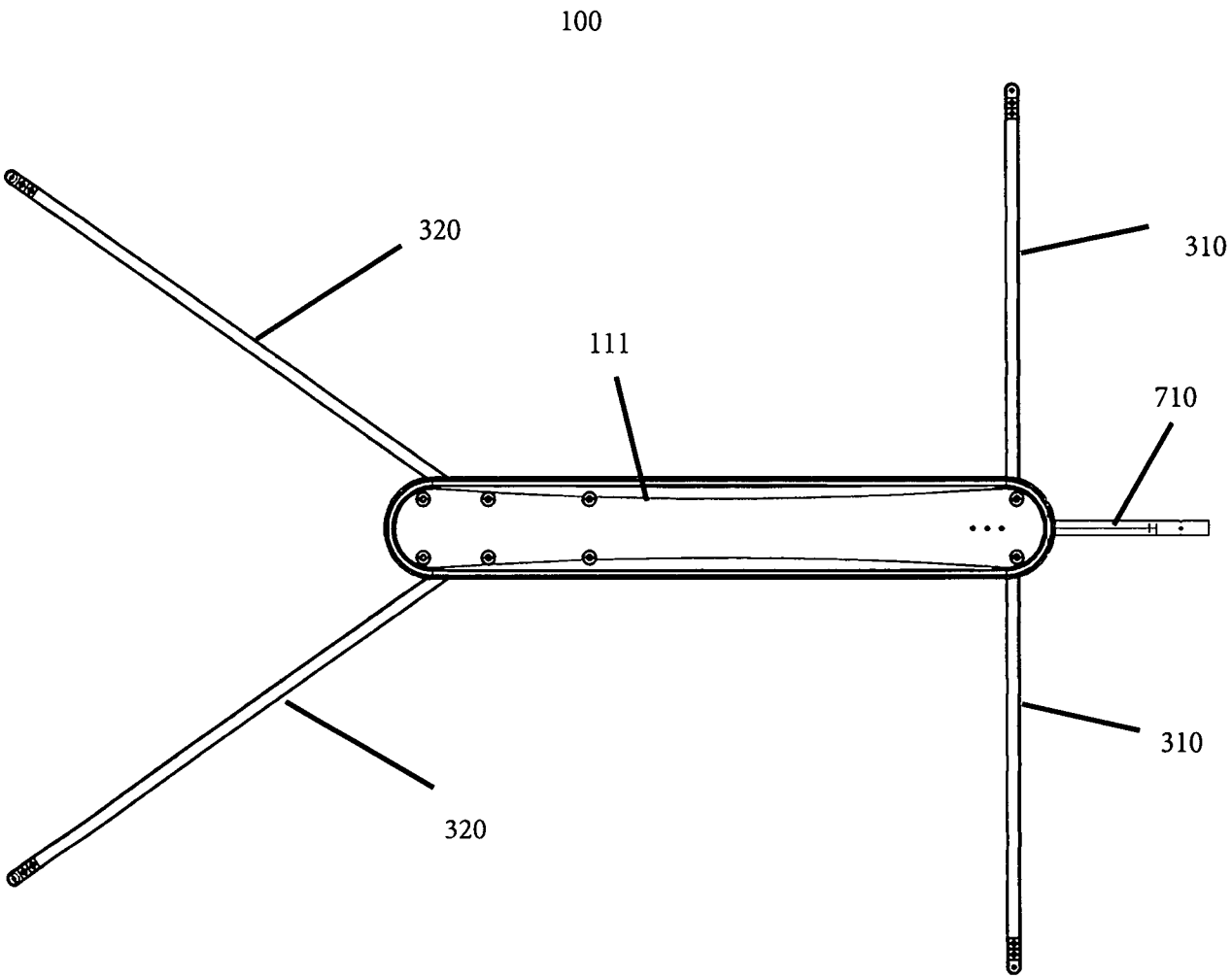
FIG. 10 presents a first alternate embodiment of the collapsible fin shade apparatus.
Figure 10A:
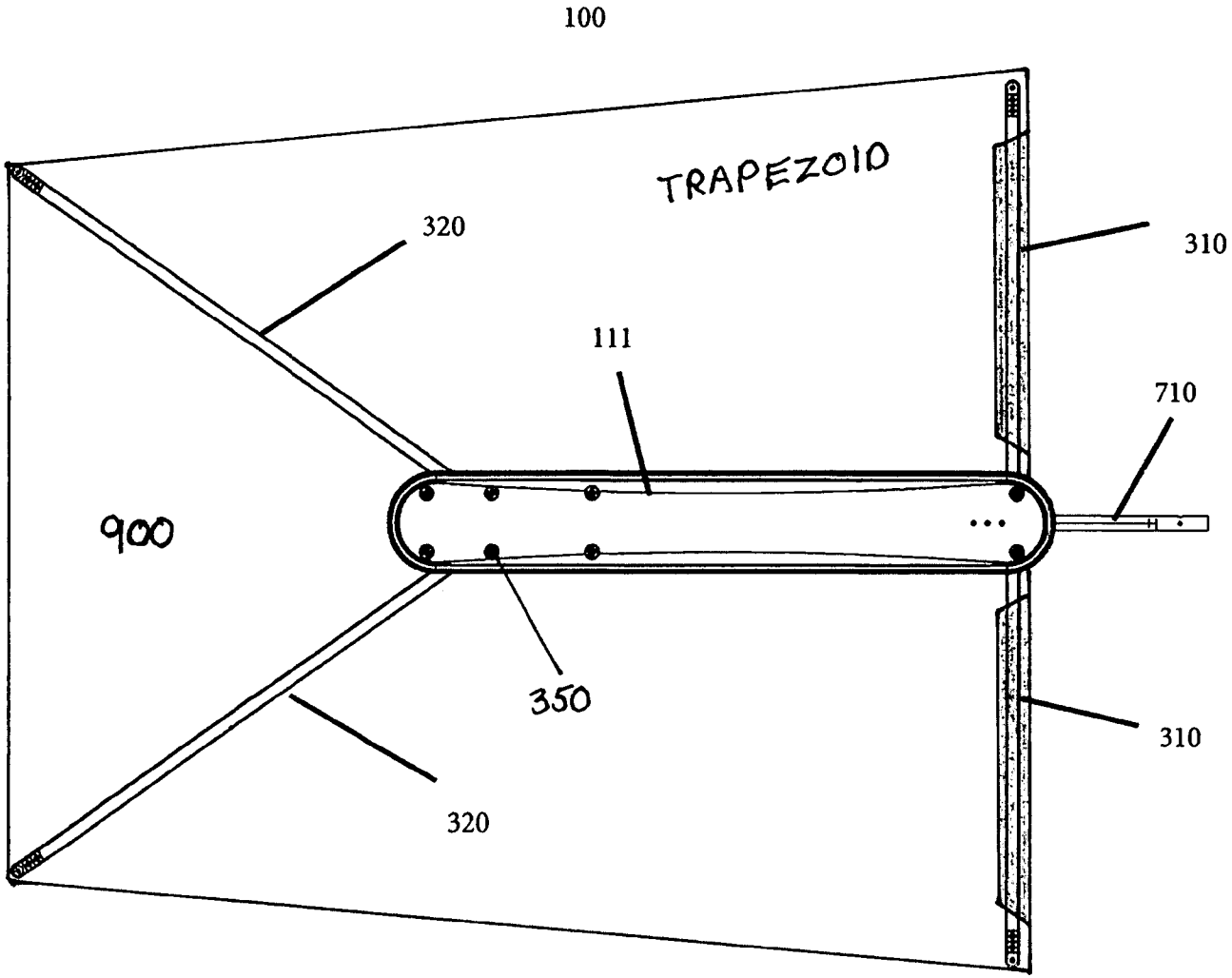
FIG. 10A presents a trapezoid shape canvas of the collapsible fin shade apparatus.
Figure 11:
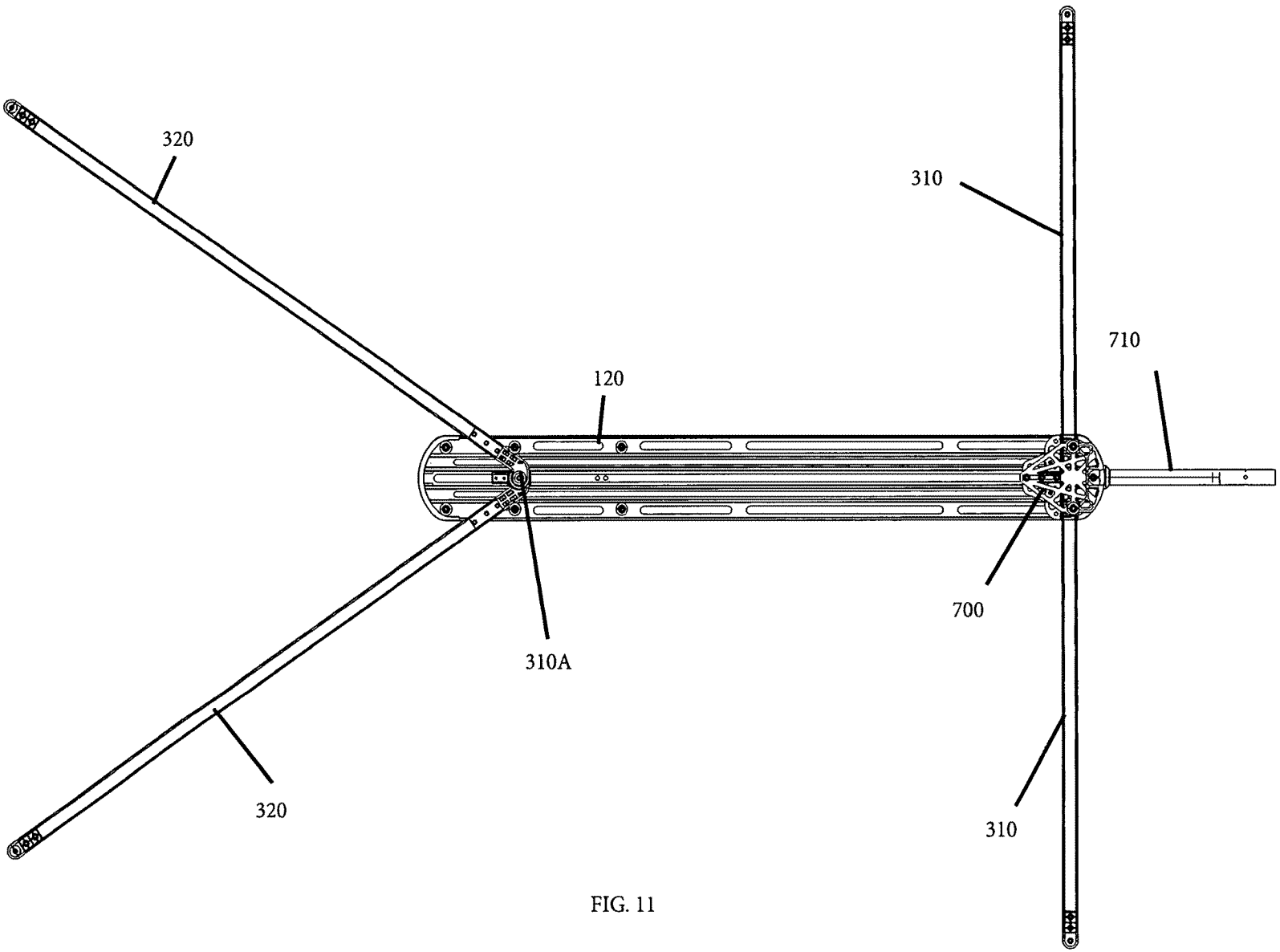
FIG. 11 presents a first alternate embodiment of the collapsible fin shade apparatus.
Figure 12:
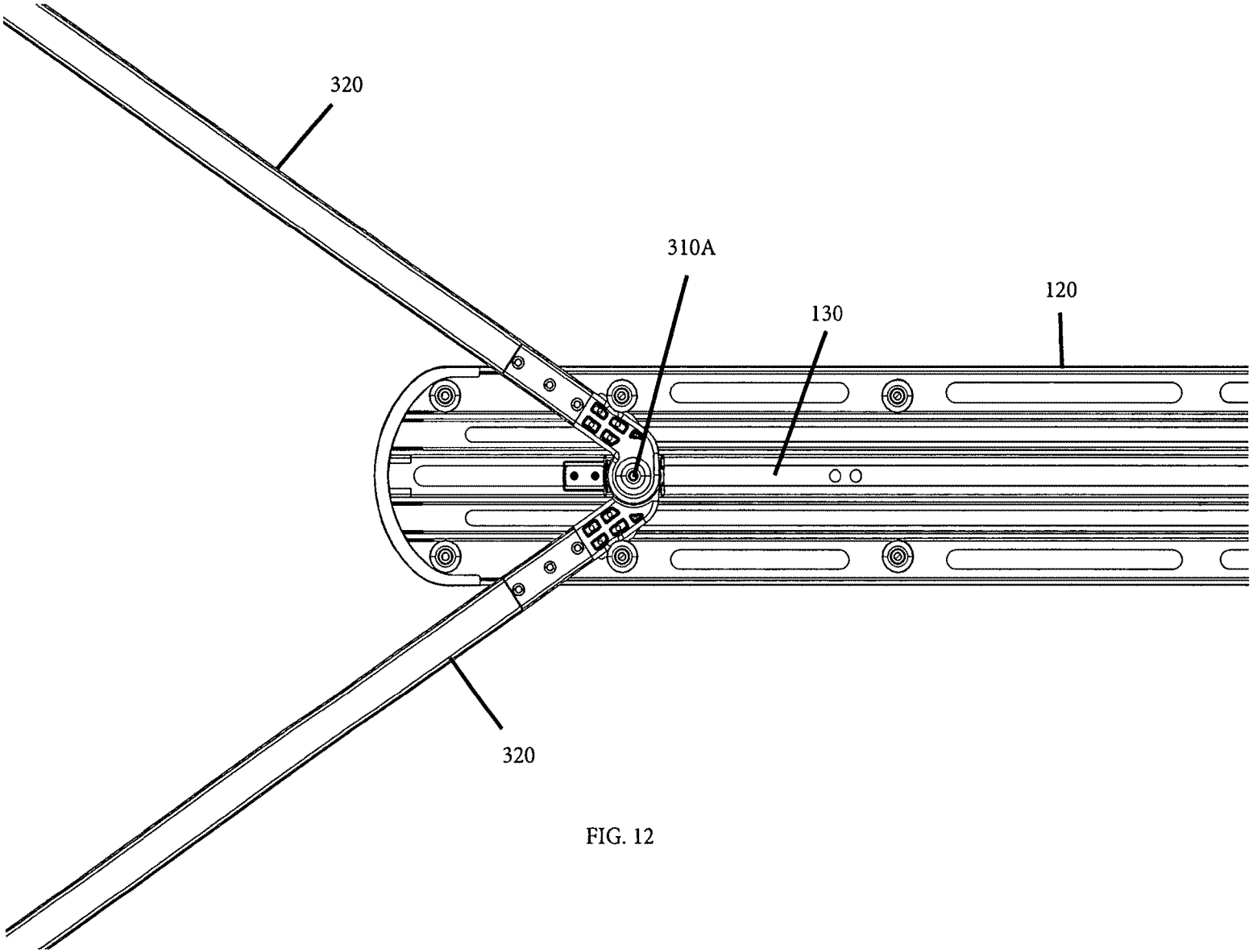
FIG. 12 presents a first alternate embodiment of the collapsible fin shade apparatus.
Figure 13:
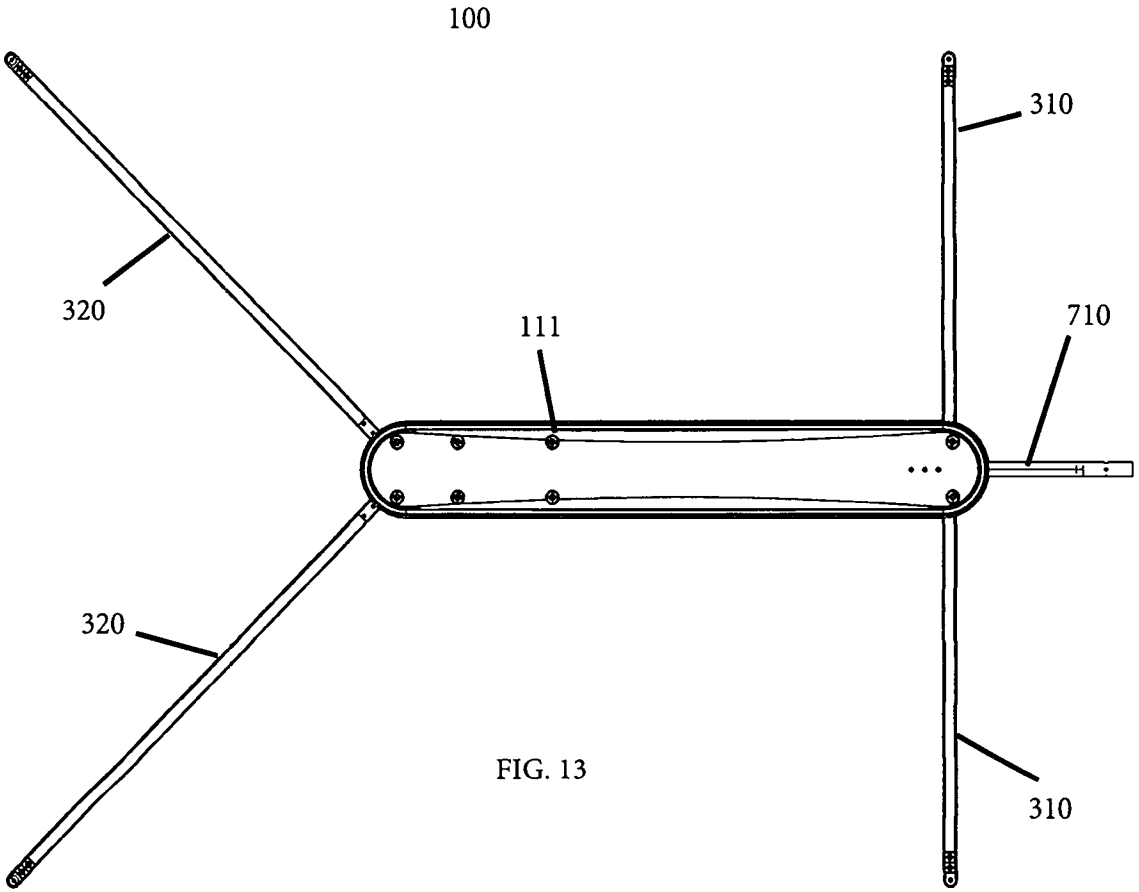
FIG. 13 presents a second alternate embodiment of the collapsible fin shade apparatus.
Figure 14:
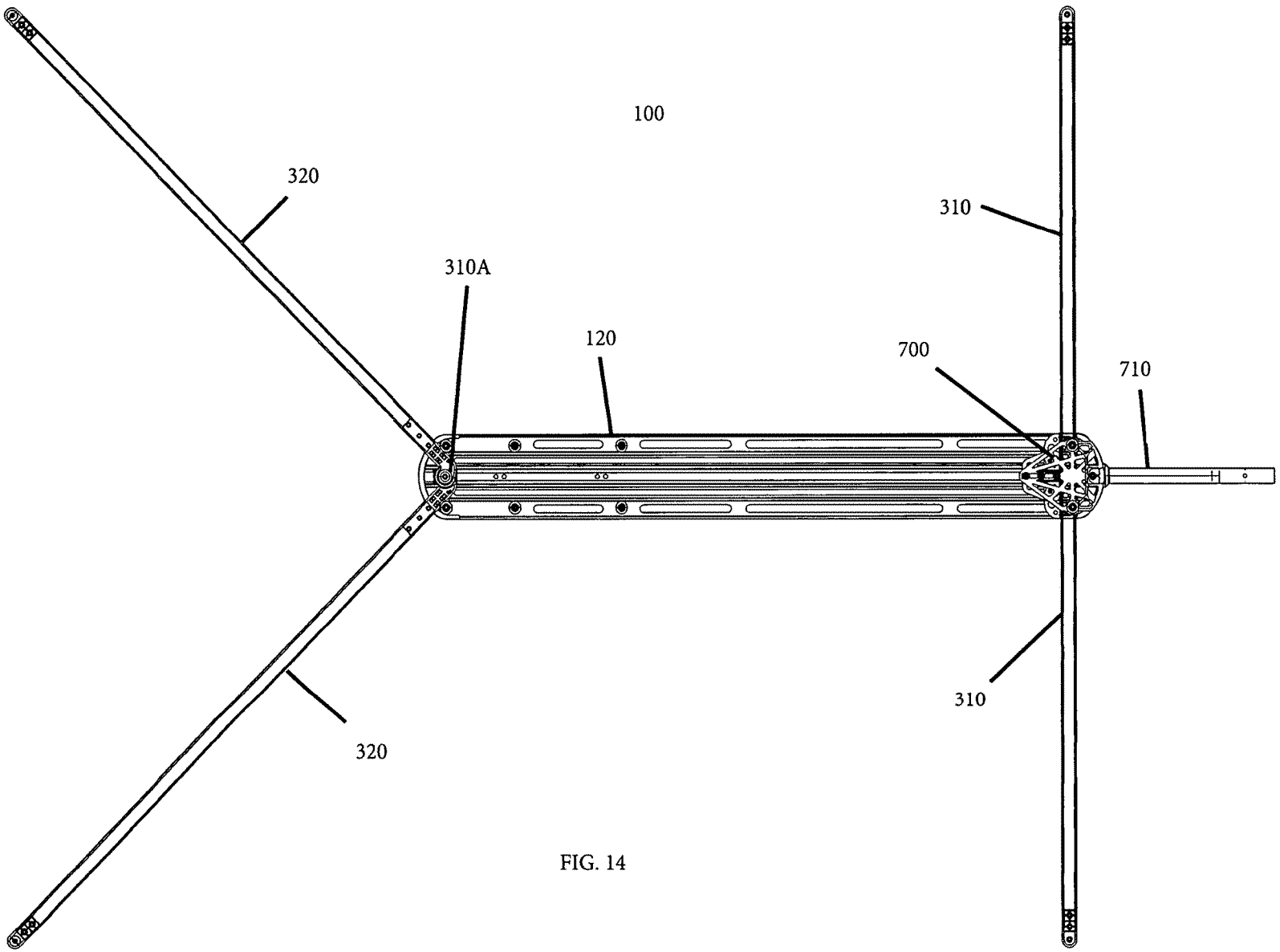
FIG. 14 presents a second alternate embodiment of the collapsible fin shade apparatus.
Figure 14A:
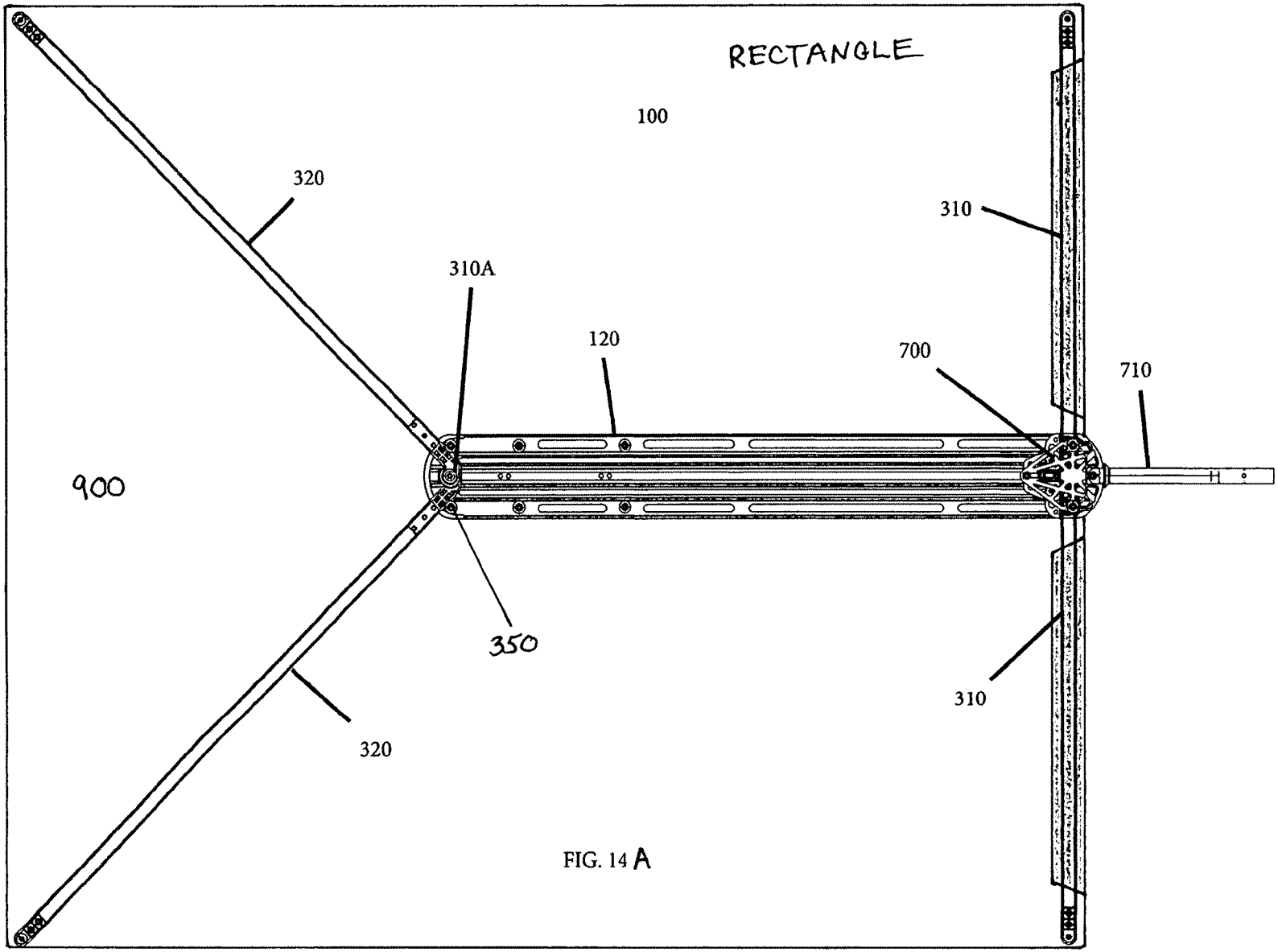
FIG. 14A presents a rectangular shape canvas of the collapsible fin shade apparatus.
Figure 15:
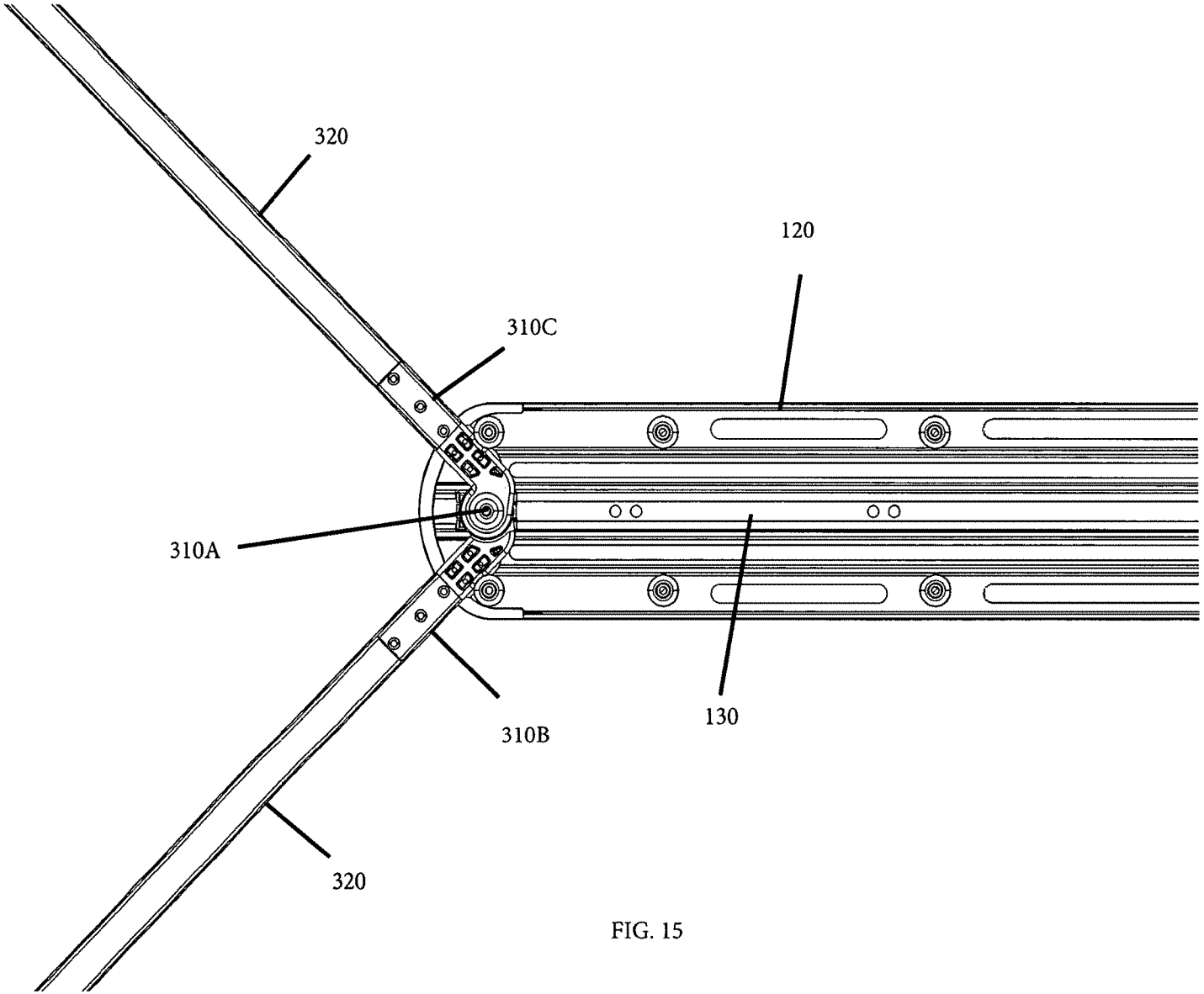
FIG. 15 presents a second alternate embodiment of the collapsible fin shade apparatus.
Figure 16:
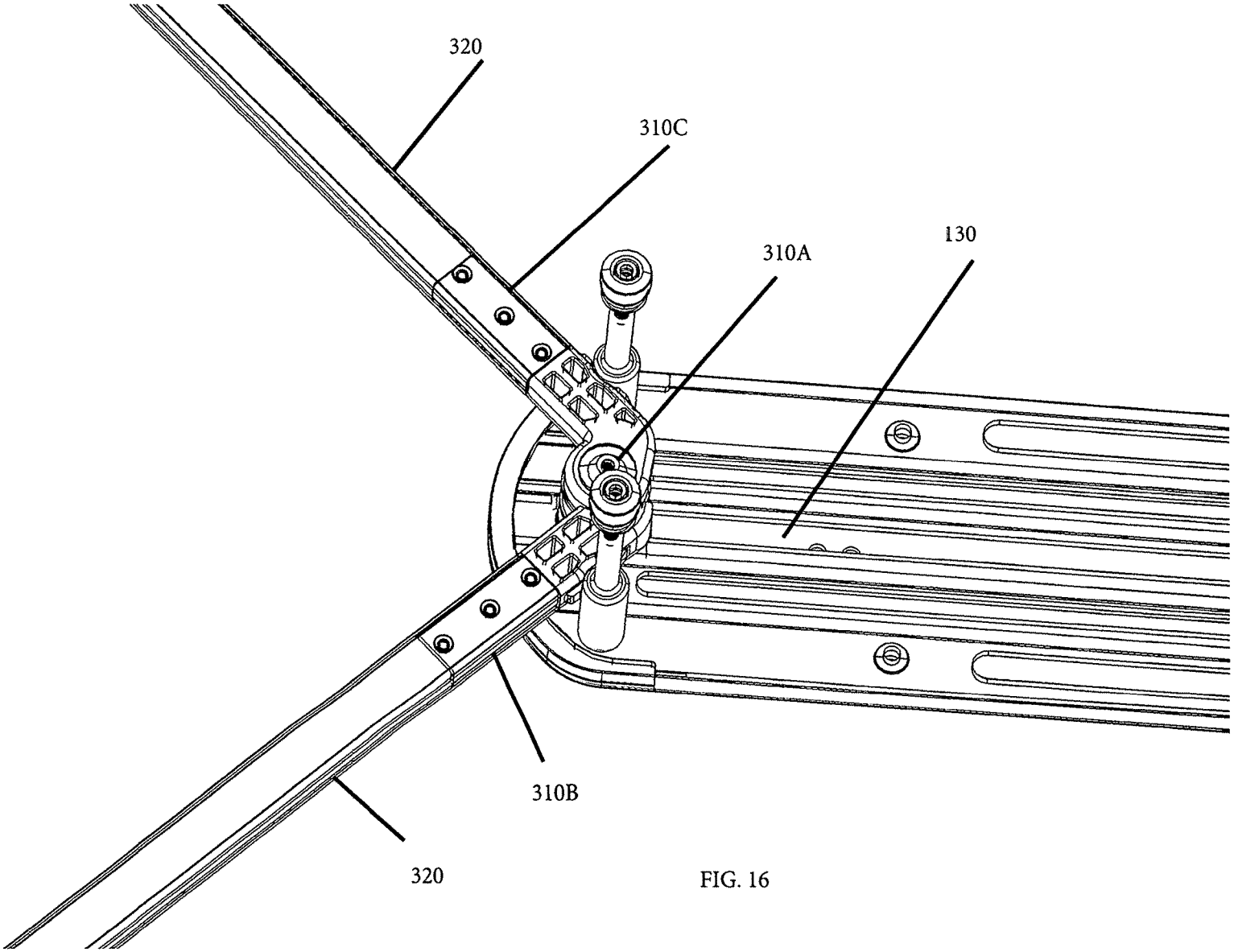
FIG. 16 presents a second alternate embodiment of the collapsible fin shade apparatus.
Figure 17:
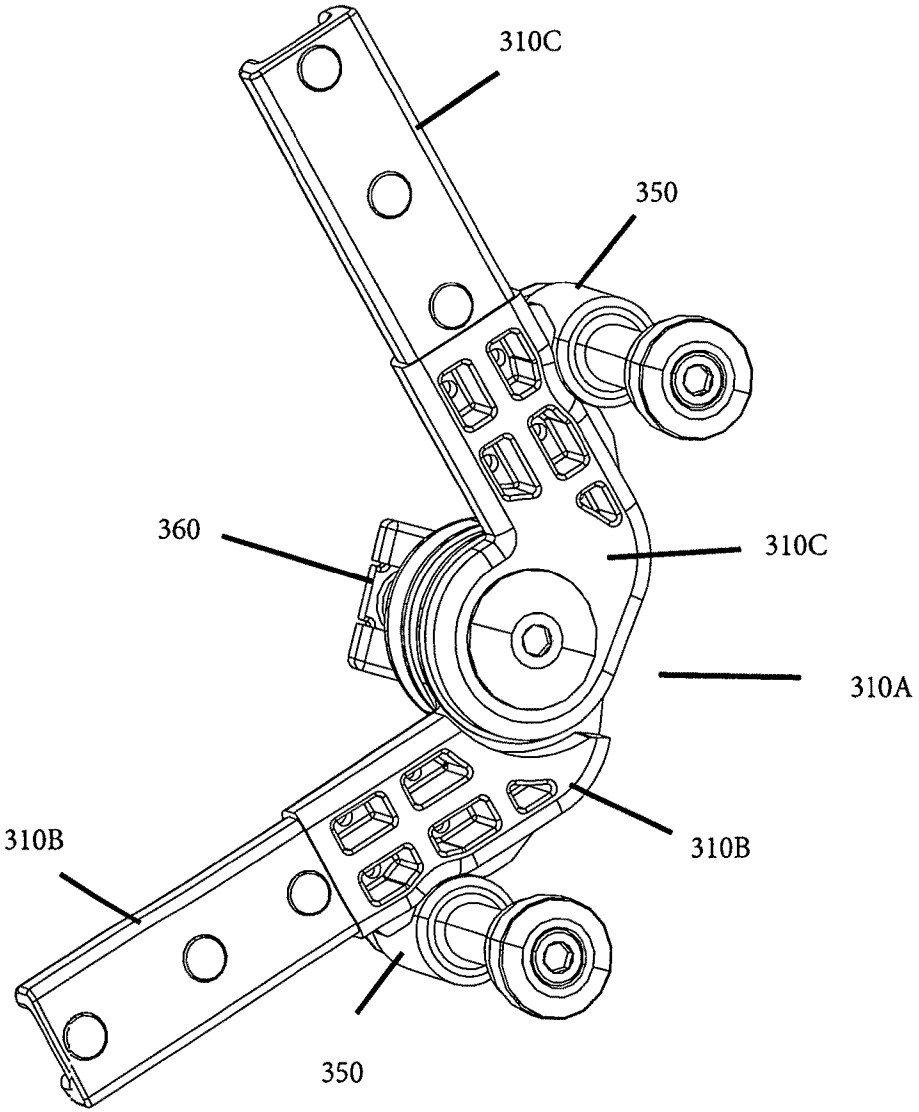
FIG. 17 presents components of the collapsible fin shade apparatus.
Figure 18:
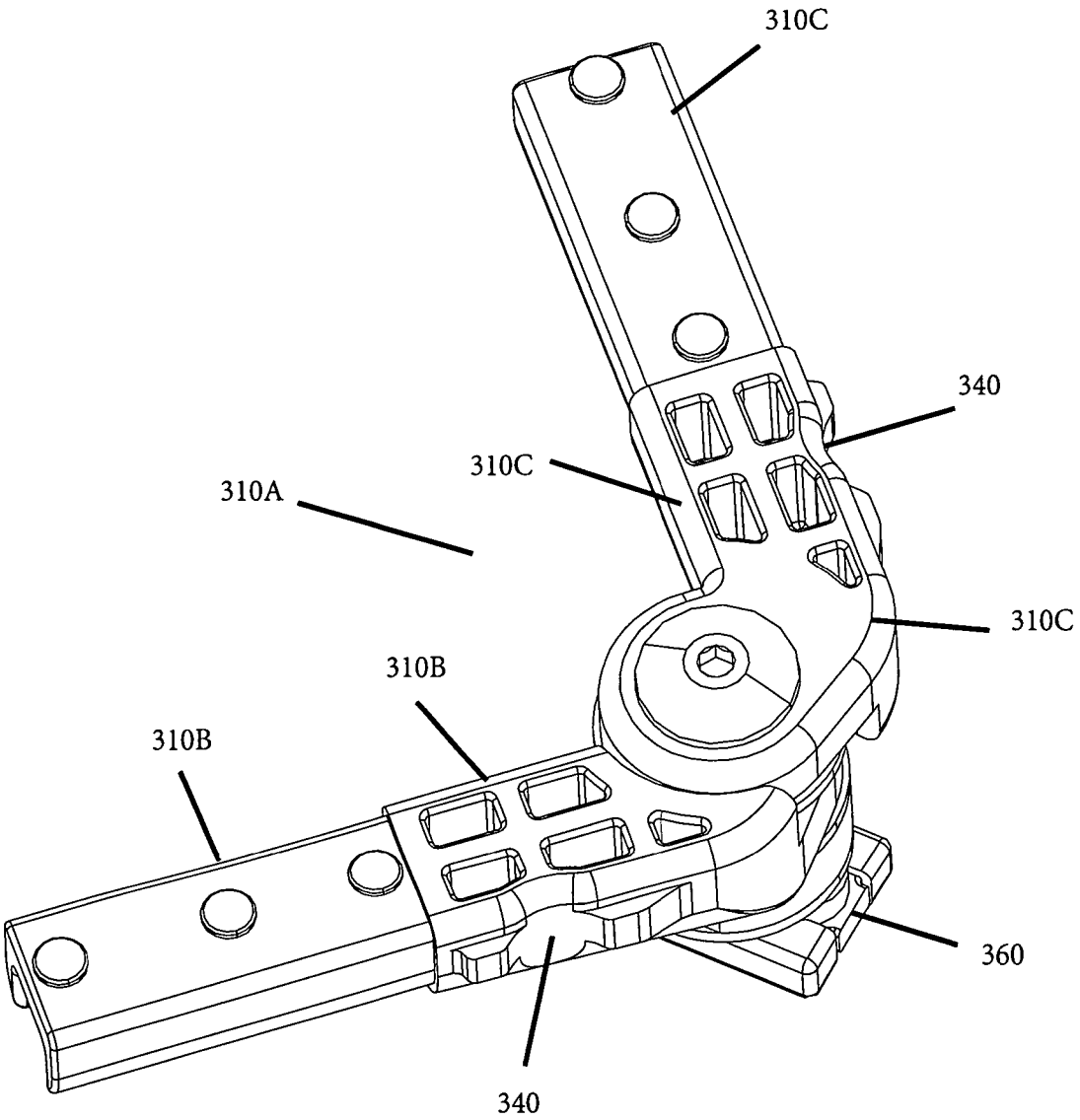
FIG. 18 presents components of the collapsible fin shade apparatus.
Figure 19:
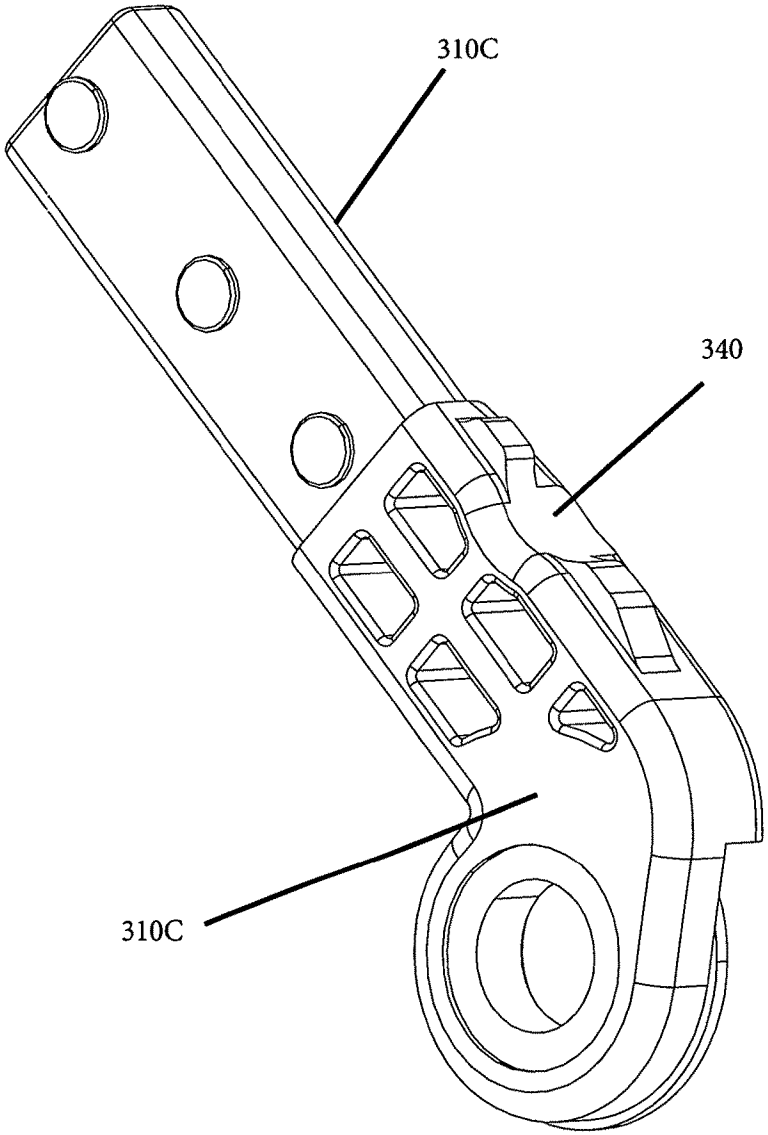
FIG. 19 presents components of the collapsible fin shade apparatus.
Figure 20:
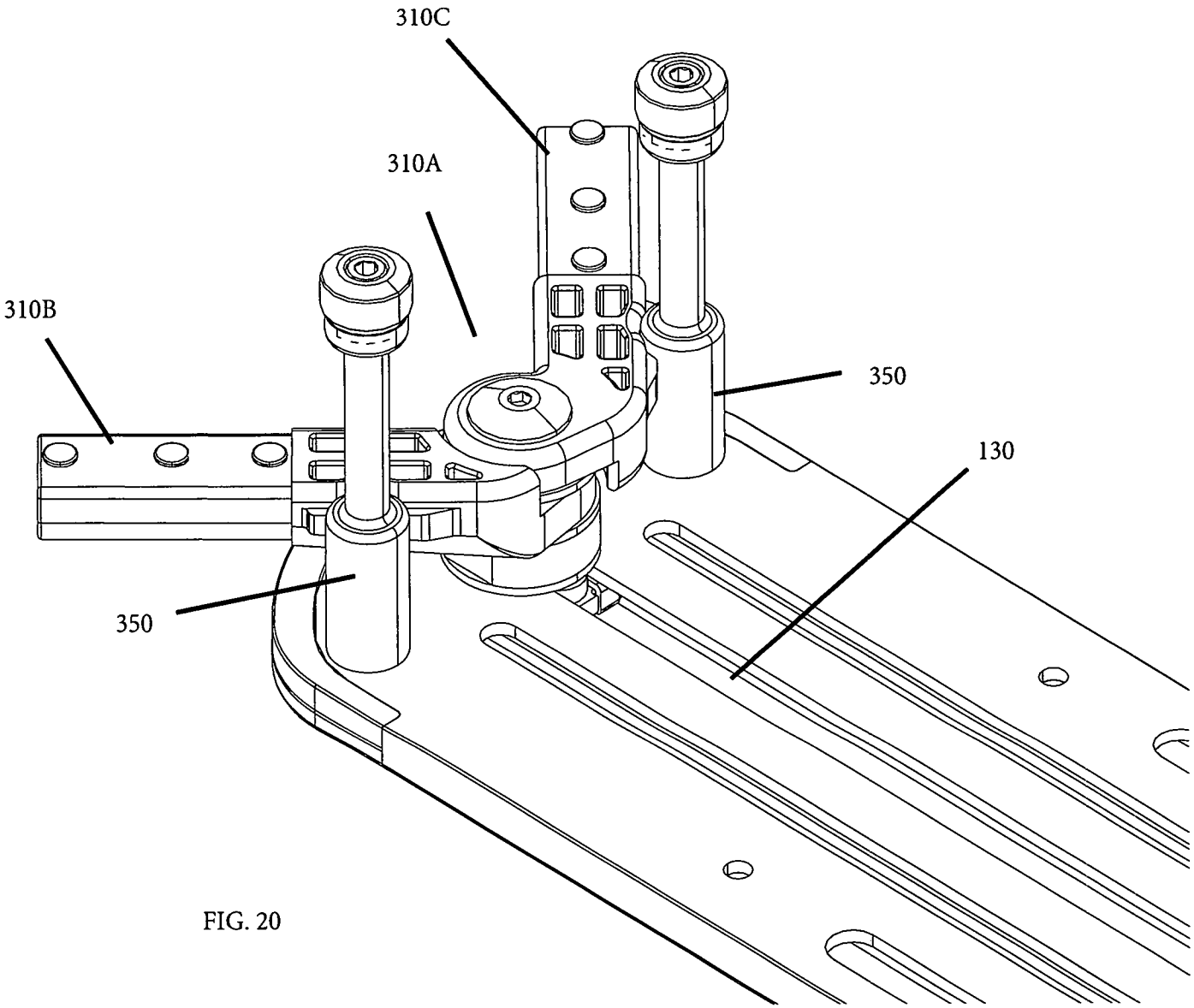
FIG. 20 presents components of the collapsible fin shade apparatus.

For example, in the first alternate embodiment as shown, for example in FIGS. 10-12) the lock post 350 are positioned to form the canvas 900 into the shape of a trapezoid. In the second alternate embodiment as shown in FIGS. 13-16 the lock post 350 are positioned to form the canvas 900 into the shape of a rectangle. Note in the preferred embodiment as shown in FIGS. 1A-9 the lock post 350 are positioned to form the canvas 900 into the shape of a square.

It is envisioned an infinite number of locations along the bottom assembly 120 can be selected to insert a lock post 350 and that the lock post 350 do not need to be positioned in parallel pairs. Further, more than one lock post 350 can be on the same side of the center track 130 of the bottom assembly 120.

There has thus been broadly outlined the more important features of the apparatus in order that the detailed description thereof that follows may be better understood, and in order that the present contribution to the art may be better appreciated. There are, of course, additional features of the apparatus that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present apparatus. It is important, therefore, that the claims be regarded as including such equivalent constructions insofar as they do not depart from the spirit and scope of the present apparatus.

Further, the purpose of the Abstract is to enable the national patent office(s) and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the apparatus of this application, which is measured by the claims, nor is it intended to be limiting as to the scope of the apparatus in any way.

The foregoing disclosure is sufficient to enable one having skill in the art to practice the apparatus without undue experimentation and provides the best mode of practicing the apparatus presently contemplated by the inventor. While there is provided herein a full and complete disclosure of embodiments of this apparatus, it is not intended to limit the apparatus to the exact construction, dimensional relationships, and operation shown and described. Various modifications, alternative constructions, changes and equivalents will readily occur to those skilled in the art and may be employed, as suitable, without departing from the true spirit and scope of the apparatus. Such changes might involve alternative materials, components, structural arrangements, sizes, shapes, forms, functions, operational features or the like. Elements of the instant apparatus may be made from a variety of known materials including wood, rubber, metal, or plastic, as well as from any suitable combination of appropriate materials.

It is understood the methods disclosed herein present the system and components which can form the apparatus for performing the methods as claimed and as disclosed. Further the use of the apparatus and system components presented herein can form the basis for the methods presented and claimed herein.

Accordingly, the proper scope of the present apparatus should be determined only by the broadest interpretation of the appended claims so as to encompass all such modifications as well as all relationships equivalent to those illustrated in the drawings and described in the specification.

What is claimed is:

1. A collapsible fin shade apparatus for attachment to a boat tower or boat top or boat cargo rack comprising:

at least one mounting support base for attachment to the boat tower or boat top or boat cargo rack;

a plurality of pivot mechanisms provided on the at least one mounting support base, wherein the pivot mechanisms are sequentially aligned with each other, and wherein the pivot mechanisms rotate about an axis perpendicular to the sequential alignment;

a spine extending from each pivot mechanism, wherein when fully extended each spine is substantially parallel to another spine; and fabric interconnecting the plurality of spines formed where the plurality of pivot mechanisms includes a spine extending from each pivot mechanism.

2. The apparatus of claim 1, wherein the fabric extends from foremost spine to the rearmost end of the mounting support base.

3. The apparatus of claim 1, wherein the plurality of pivot mechanisms are aligned in a straight line thereby providing a plurality of pivot points along the mounting support base thus enabling an area of fabric coverage that spans from a front of the mounting support base to a rear of the mounting support base.

4. The apparatus of claim 1 further comprising:

wherein each spine further includes a spine support base; and at least one gas spring attaching together the spine support base and one of the at least one mounting support base to assist in keeping the spine in a selected position.

5. The apparatus of claim 1 wherein in the retracted position the spines along with the fabric are folded into an open end of the at least one mounting support base.

6. A collapsible fin shade apparatus for attachment to a boat tower or boat top or boat cargo rack comprising:

at least one mounting support base for attachment to the boat tower or boat top or boat cargo rack;

a plurality of translatable pivot mechanisms provided on the at least one mounting support base, wherein the pivot mechanisms are sequentially aligned with each other, and wherein the pivot mechanisms rotate about an axis perpendicular to the sequential alignment;

a spine extending from each pivot mechanism, wherein when fully extended each spine is substantially parallel to another spine; and fabric interconnecting the plurality of spines formed where the plurality of pivot mechanisms includes a spine extending from each pivot mechanism.

7. The apparatus of claim 6 further comprising:

wherein each spine extending from each pivot mechanism includes a complimentary spine extending from the opposite side of the mounting support base.

8. The apparatus of claim 6 further comprising:

lock posts positioned on the mounting support base to stop the translation of the adjacent pivot mechanism, wherein each spine includes a locking detent so that translation of the pivot mechanism stops when the locking detent of the respective spine abuts the respective lock post.

* * * * *